US011085736B2

(12) United States Patent
Johnson, Sr. et al.

(10) Patent No.: US 11,085,736 B2
(45) Date of Patent: Aug. 10, 2021

(54) BALL HEAD BASED CLAMPING DEVICE

(71) Applicant: Really Right Stuff, LLC, Lehi, UT (US)

(72) Inventors: Joseph M. Johnson, Sr., Lehi, UT (US); Brandon Bray, Lehi, UT (US)

(73) Assignee: Really Right Stuff, LLC, Lehi, UT (US)

( * ) Notice: Subject to any disclaimer, the term of this patent is extended or adjusted under 35 U.S.C. 154(b) by 133 days.

(21) Appl. No.: 16/274,061

(22) Filed: Feb. 12, 2019

(65) Prior Publication Data

US 2019/0331460 A1 Oct. 31, 2019

Related U.S. Application Data

(60) Provisional application No. 62/663,516, filed on Apr. 27, 2018.

(51) Int. Cl.
*F41G 11/00* (2006.01)
*F41A 23/12* (2006.01)

(52) U.S. Cl.
CPC ..... *F41G 11/003* (2013.01); *F41A 23/12* (2013.01)

(58) Field of Classification Search
CPC ..... F41G 11/003
See application file for complete search history.

(56) References Cited

U.S. PATENT DOCUMENTS 3,324,558 A 6/1967 Hart
3,750,318 A 8/1973 Burris
4,079,534 A 3/1978 Snyder
5,020,260 A 6/1991 Houghton
5,155,915 A 10/1992 Repa
5,276,988 A 1/1994 Swan
5,347,740 A 9/1994 Rather et al.
5,467,552 A 11/1995 Cupp et al.
5,533,292 A 7/1996 Swan
5,581,046 A 12/1996 Weldle et al.
5,680,725 A 10/1997 Bell
5,806,228 A 9/1998 Martel et al.
5,816,683 A 10/1998 Christansen
5,913,668 A 6/1999 Messer
5,930,935 A 8/1999 Griffin
6,272,785 B1 8/2001 Mika et al.
6,295,754 B1 10/2001 Otteman et al.
6,318,014 B1 11/2001 Porter
6,442,883 B1 9/2002 Waterman et al.
6,499,245 B1 12/2002 Swan
6,526,687 B1 3/2003 Looney
6,574,899 B1 6/2003 Mostello
6,618,976 B1 9/2003 Swan
6,773,172 B1 8/2004 Johnson et al.
6,779,290 B1 8/2004 Houtsma
6,874,269 B2 4/2005 Chen et al.
6,922,934 B1 8/2005 Huan
7,077,582 B2 7/2006 Johnson
7,107,716 B1 9/2006 Liao
7,131,228 B2 11/2006 Hochstrate et al.
(Continued)

FOREIGN PATENT DOCUMENTS

EP 3381793 A1 10/2018

*Primary Examiner* — Clayton E. LaBalle
*Assistant Examiner* — Dennis Hancock
(74) *Attorney, Agent, or Firm* — Chernoff, Vilhauer, McClung & Stenzel, LLP

(57) ABSTRACT

A ball head based lever clamping device.

11 Claims, 31 Drawing Sheets

(56) References Cited

U.S. PATENT DOCUMENTS

RE39,465 E 1/2007 Swan
7,240,600 B1 7/2007 Bordson
7,260,912 B2 8/2007 Liu
7,305,790 B2 12/2007 Kay
7,313,884 B2 1/2008 Eddins
7,493,721 B2 2/2009 Swan
7,614,175 B2 11/2009 Davis et al.
7,739,824 B1 6/2010 Swan
7,757,422 B1 7/2010 Swan
7,757,423 B1 7/2010 Swan
7,793,452 B1 9/2010 Samson et al.
7,802,395 B1 9/2010 Swan
7,810,271 B2 10/2010 Patel
7,823,318 B2 11/2010 Hall
7,886,476 B1 2/2011 Swan
7,905,045 B1 3/2011 Swan
7,908,782 B1 3/2011 LaRue
7,938,055 B2 5/2011 Hochstrate et al.
8,348,214 B2 * 1/2013 Vogt ..... G03B 17/566 248/316.4
8,398,037 B2 3/2013 Johnson et al.
8,549,786 B1 10/2013 Griffith
8,567,105 B1 10/2013 Bobro
8,806,796 B1 8/2014 Clifton
9,298,069 B2 3/2016 Johnson, Sr.
D757,886 S 5/2016 Cheng et al.
9,464,863 B2 10/2016 Mather et al.
9,671,198 B2 6/2017 Bartoszewicz
10,048,040 B1 8/2018 Ratliff
10,612,718 B2 * 4/2020 Johnson, Sr. ..... F16M 11/041
10,883,650 B2 * 1/2021 Johnson, Sr. ..... F41G 11/003
2002/0162267 A1 11/2002 Nelson et al.
2005/0041966 A1 * 2/2005 Johnson ..... F16M 11/041 396/428
2006/0117636 A1 6/2006 Newhall et al.
2006/0123686 A1 6/2006 Larue
2006/0177215 A1 * 8/2006 Johnson ..... F16M 11/16 396/419
2006/0207156 A1 9/2006 Larue
2007/0033851 A1 2/2007 Hchstrate et al.
2008/0092421 A1 4/2008 Beckmann
2008/0168696 A1 7/2008 Orne et al.
2008/0178511 A1 7/2008 Storch et al.
2008/0216380 A1 9/2008 Teetzel
2009/0038201 A1 2/2009 Cheng et al.
2010/0018101 A1 * 1/2010 Moody ..... G03B 17/561 42/72
2010/0107467 A1 5/2010 Samson et al.
2010/0122485 A1 5/2010 Kincel
2010/0307042 A1 12/2010 Jarboe et al.
2012/0167438 A1 7/2012 Daniel et al.
2013/0000176 A1 1/2013 Goertzen
2013/0236235 A1 * 9/2013 Johnson, Sr. ..... F16M 13/00 403/53
2013/0256484 A1 10/2013 Kessler et al.
2013/0283663 A1 10/2013 Joplin
2014/0373329 A1 12/2014 Volfson
2015/0068095 A1 3/2015 Collin et al.
2019/0145731 A1 * 5/2019 Stewart ..... F41C 27/00 42/90
2019/0162362 A1 * 5/2019 Chen ..... F16B 2/18
2019/0331459 A1 * 10/2019 Johnson, Sr. ..... F41G 11/003

* cited by examiner

BALL HEAD BASED CLAMPING DEVICE

CROSS-REFERENCE TO RELATED APPLICATIONS

This application claims the benefit of U.S. Provisional Patent Application No. 62/663,516, filed Apr. 27, 2018. entitled Ball Head Based Clamping Device.

BACKGROUND OF THE INVENTION

The present invention relates to a clamping device. More specifically, a ball head based dual clamping device that works in conjunction with commonly available dovetail brackets for imaging devices and commonly available accessory rails for rifles.

A Picatinny rail, also known as a MIL-STD-1913 rail, or Standardization Agreement 2324 rail, or also generally a NATO Accessory Rail referred to as STANAG 4694, is a bracket on some firearms that provides a mounting platform consisting of rails with multiple transverse slots. Referring to FIG. 1, the dimensions of the NATO Accessory Rail is illustrated. The Picatinny rail is designed to mount heavy sights and other attachments to the upper, side, or lower surfaces of all manner of weapons from crossbows to pistols and long arms up to and including anti-materiel rifles. The Picatinny rail consists of a strip undercut to form a flattened T cross-section provided with crosswise slots at intervals interspersed with flats that allow accessories to be slid into place from the end of the rail then locked in place; slid into the slots between raised flats then moved a short distance back or forth or clamped to the rail with bolts, and thumbscrews or levers. The Picatinny locking slot width is 0.206 in (5.23 mm). The spacing of slot centers is 0.394 in (10.01 mm) and the slot depth is 0.118 in (3.00 mm).

Referring to FIG. 2, FIG. 3, and FIG. 4 a NATO Picatinny Dovetail Adapter is illustrated. The adapter includes a body 100 with a clamp 110 that is movable with respect to the body 100. A set of three threaded screws 120, each of which may include a countersunk head 130, is rotatably interconnected with matching threads on the body 100. By rotation of the threaded screws 120, the clamp 110 is moved laterally with respect to the body 100. The body 100 defines a pair of dovetail groves 140 that fit clamps.

Referring also to FIG. 5, the three screws 120 are loosened using a hex key until the jaw is fully opened. The body 100 is installed onto the rail 150 by aligning the screws with the slots in the rail. Each of the screws 120 are lightly tightened, and then further tightened using a torque wrench. Referring to FIG. 6, with the adapter securely affixed to the rail 150, a quick release clamp 160 may be detachably attached to the dovetail grooves 140 to support the firearm on a tripod.

The traditional manner of achieving maximum accuracy in rifle shooting requires a shooter to be prone, lying on the ground, or requires the rifle to be rigidly supported on a bench support. However, the prone position is often obstructed by obstacles (such as tall grass, fallen trees, low walls, and even rises and falls in geography) and a bench support is rarely available while hunting, in mobile shooting competitions, or on a battlefield.

The stability with which a rifle may be maintained is important to the accuracy with which it can be fired. Conversely, the ease of transporting a rifle and ancillary equipment, as well as the speed with which it can be brought to bear, can be important to success during hunting. Often these considerations are at odds with one another, with stability being obtained by burdensome and complicated equipment, and with ease of transporting a rifle and ancillary equipment being obtained with equipment that compromises stability.

Equipment suitable for fully unsupported shooting positions typically rely on bone support rather than muscle support for the rifle to reduce fatigue and movement of the rifle during shooting. Often the unsupported shooting positions will include a sling to reduce strain on the bicep of the supporting arm to further stabilize the rifle shooting position. While shooting with an unsupported position requires little more than a rifle for transport and can assume a shooting position quickly, there are substantial limits to the stability with which the rifle may be held, even when using a sling to stabilize and support the shooting arm.

Equipment suitable for fully supported shooting positions typically rely on a rifle rest, such as those available at commercial shooting ranges, that not only completely support the rifle, but also substantially reduce the felt recoil. While suitable for a commercial shooting range, such rifle rests are unworkable in a hunting situation because they are intended to be utilized with shooting benches. Moreover, the rifle rests often rely to a large extent on weight to reduce the felt recoil, making their transportation during hunting impractical.

U.S. Pat. No. 6,574,899 discloses a tripod mounted combined gun rest and arm rest. The gun rest includes a platform adapted to be mounted on a tripod. The platform includes a forward gun cradle and a rear gun cradle, each of which is mounted in an adjustment slot disposed within the platform. The tripod is a conventional photographic tripod. The forward gun cradle and the rear gun cradle can be adjusted so that the center of gravity of the gun is centered over the tripod. The platform with cradles tends to be relatively complicated, and the rifle recoil tends to result in disrupting the position of the tripod making repeated shooting burdensome because the tripod needs to be readjusted.

U.S. Pat. No. 6,272,785 discloses a gun holder device that includes a gun support device with a body that defines a channel therein, with the channel being structured to resist lateral motion of the gun. The gun support device is structured to be mounted on a tripod, which may be a conventional tripod that is typically used in photography. In addition to being burdensome to carry, the rifle recoil tends to result in disrupting the position of the tripod making repeated shooting burdensome because the tripod needs to be readjusted.

U.S. Pat. No. 5,347,740 discloses a combination camera mount and gun mount. The gun mount includes mounting units for holding a rifle, attached at either end of the mounting beam. The mounting beam is pivotally attached to a cylindrical post, which is held in place by the mounting unit. A camera mount may be attached to the mounting beam. The rifle recoil tends to result in disrupting the position of the tripod making repeated shooting burdensome because the tripod needs to be readjusted.

U.S. Pat. No. 5,913,668 discloses a weapon rest having a base in the form of a tripod supporting a shaft. A cradle is pivotally secured to the top of the shaft. A swivel head at the top of the shaft permits horizontal rotation of the cradle, while the pivot pin permits vertical rotation of the cradle. A spring is connected between the shaft and cradle to provide tension, which is claimed to enhance accuracy. The rifle recoil tends to result in disrupting the position of the tripod making repeated shooting burdensome because the tripod needs to be readjusted.

U.S. Pat. No. 7,313,884 discloses a recoil suppressing gun support. The gun support includes a base member that is structured to mount on the window sill of a hunting shelter. A barrel support is mounted on one end of the base. A cradle is mounted on the opposite end of the base. A mounting plate is attached to the bottom surface of the base by a bolt, in a manner that permits rotation of the base relative to the mounting plate.

U.S. Pat. No. 7,823,318 discloses a rifle recoil absorption system. The recoil absorption system includes a harness having a large loop of webbing material extending along both sides of the fore stock and stock of the rifle, wrapping around the butt. Smaller loops extending around the shoulder stock and fore stock, respectively, hold the loop in place. An attachment strap is secured to the loop of the rifle harness. The attachment strap passes underneath a table, and attaches to the back end of the table by utilizing a U-shaped clamp.

U.S. Pat. No. 8,549,786 discloses another rifle recoil absorption system.

Unfortunately, when the firearm is not being used with a compatible clamp the shooter may desire to remove the adapter from the firearm in an efficient manner which is a burdensome task. Also, the clamp that is detachably secured to the adapter tends to permit the firearm to slide within the clamp if not sufficiently secured in an efficient manner. Moreover, the compatible clamp should be sufficiently straightforward to use while reducing the likelihood of losing lockup during articulation.

The foregoing and other objectives, features, and advantages of the invention may be more readily understood upon consideration of the following detailed description of the invention, taken in conjunction with the accompanying drawings.

DETAILED DESCRIPTION OF PREFERRED EMBODIMENT

Figure 1:
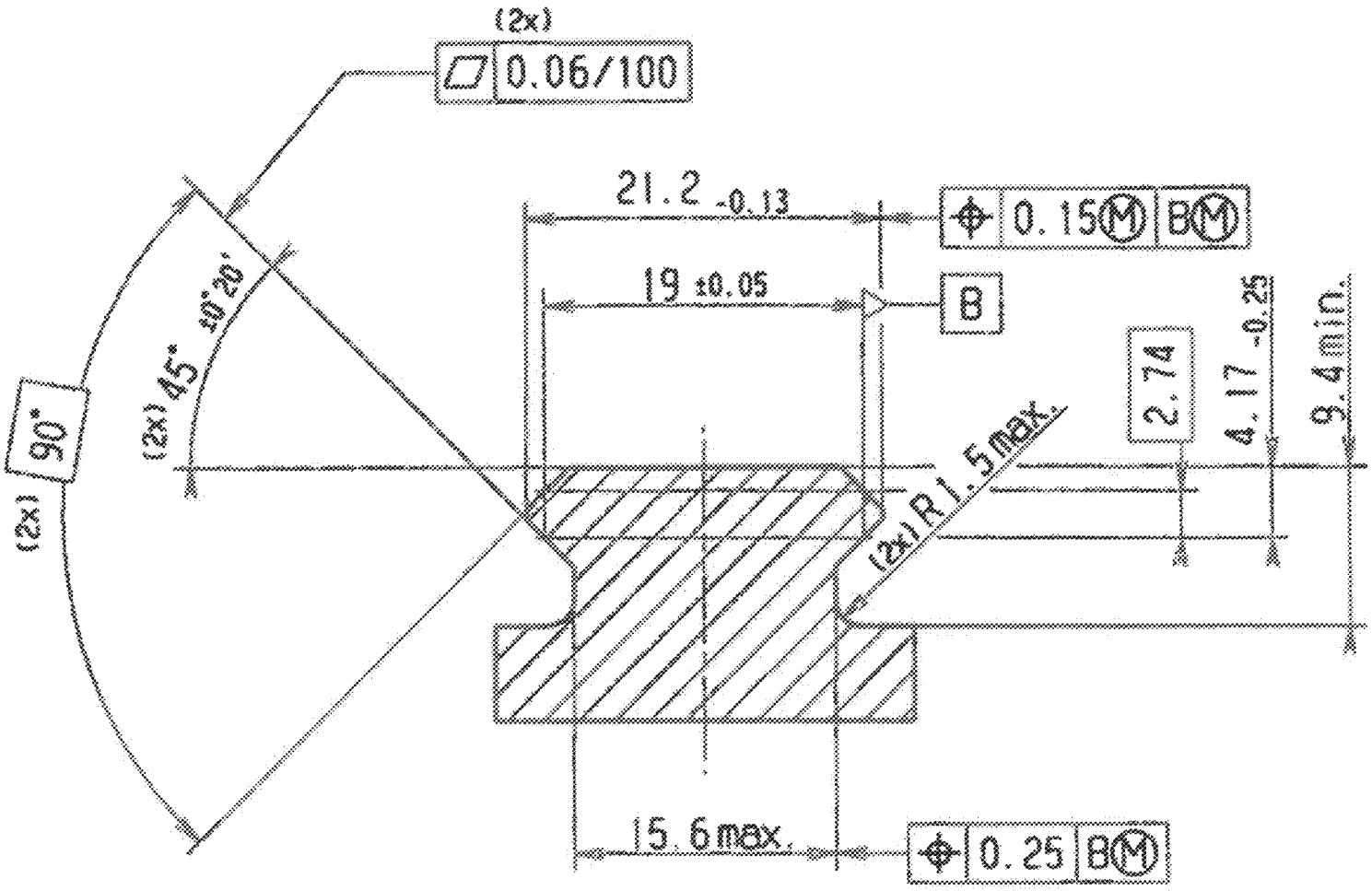
FIG. 1 PRIOR ART
FIG. 1 illustrates a NATO Accessory Rail.
Figure 2:
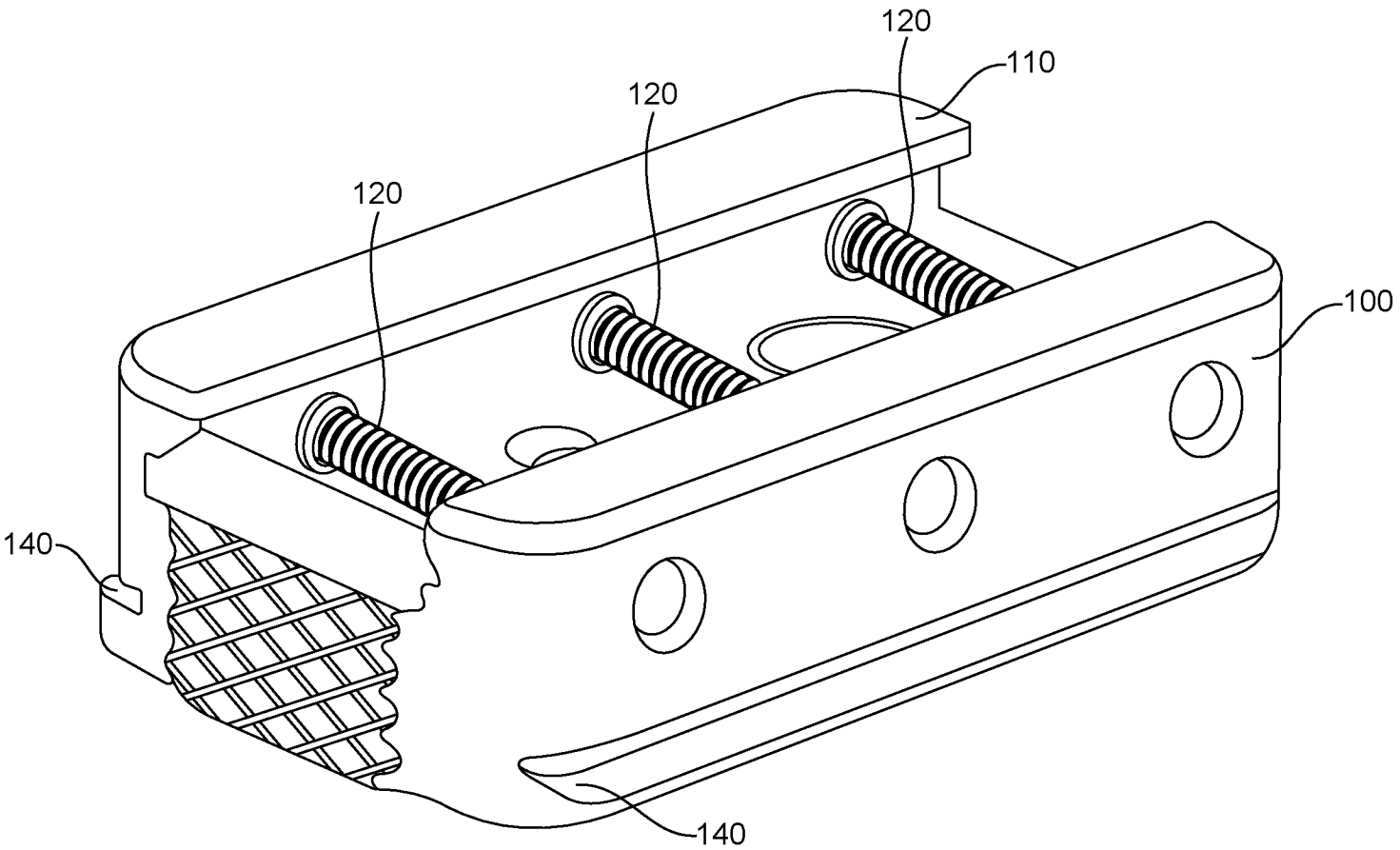
(Prior Art) FIG. 2
FIG. 2 illustrates a top perspective view of a NATO Picatinny Dovetail Adapter.
Figure 3:
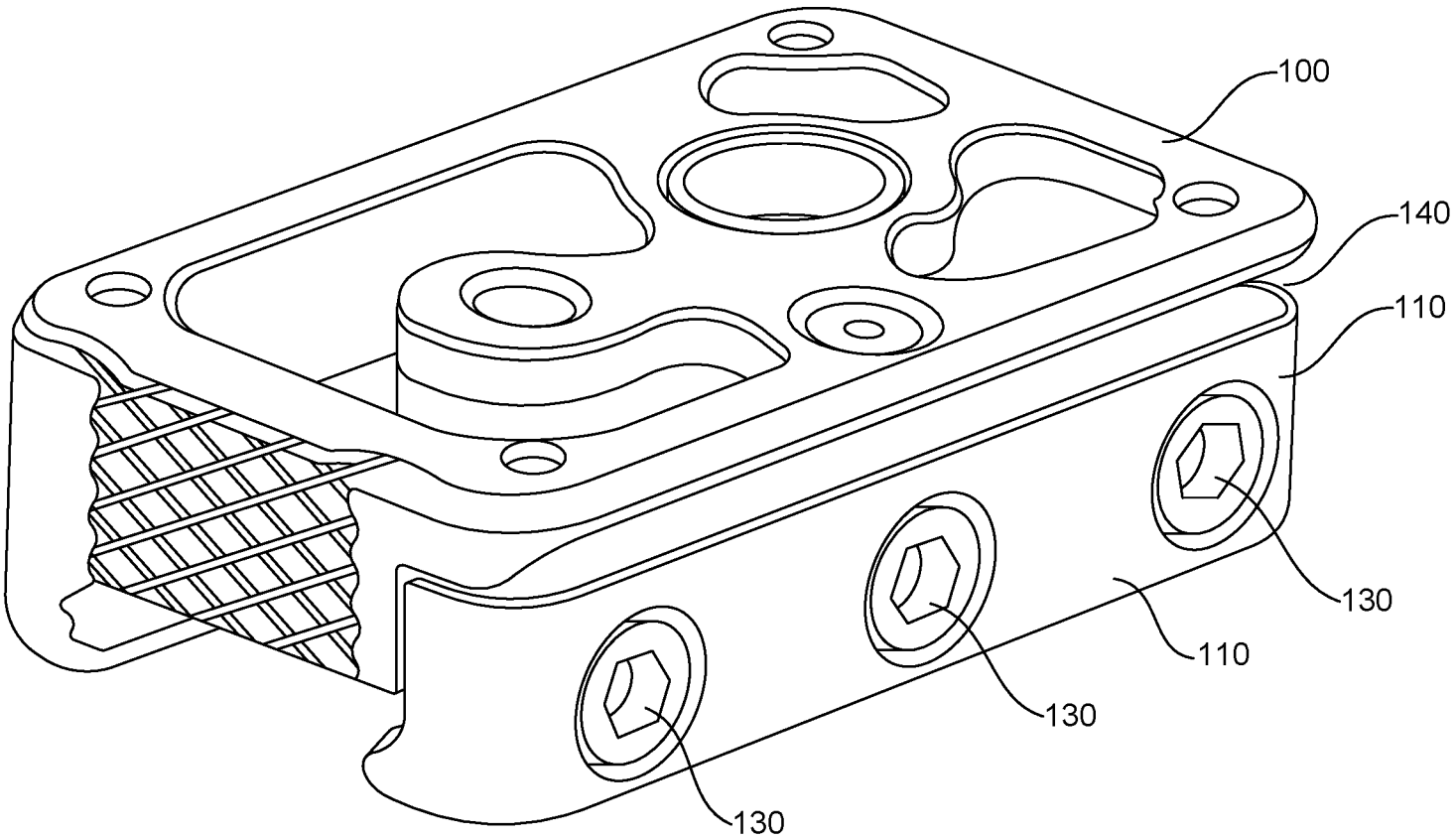
(Prior Art) FIG. 3
FIG. 3 illustrates a bottom perspective view of the NATO Picatinny Dovetail Adapter of FIG. 2.
Figure 4:
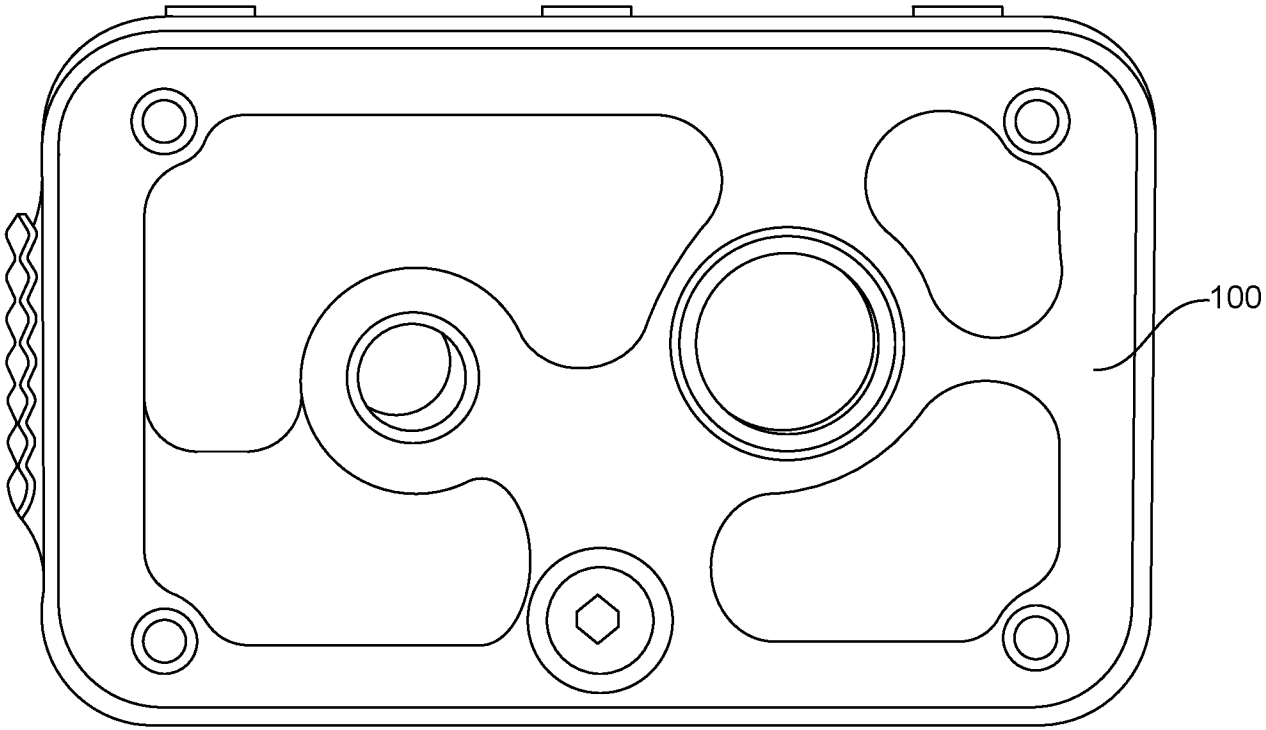
(Prior Art) FIG. 4
FIG. 4 illustrates a bottom view of the NATO Picatinny Dovetail Adapter of FIG. 2.
Figure 5:
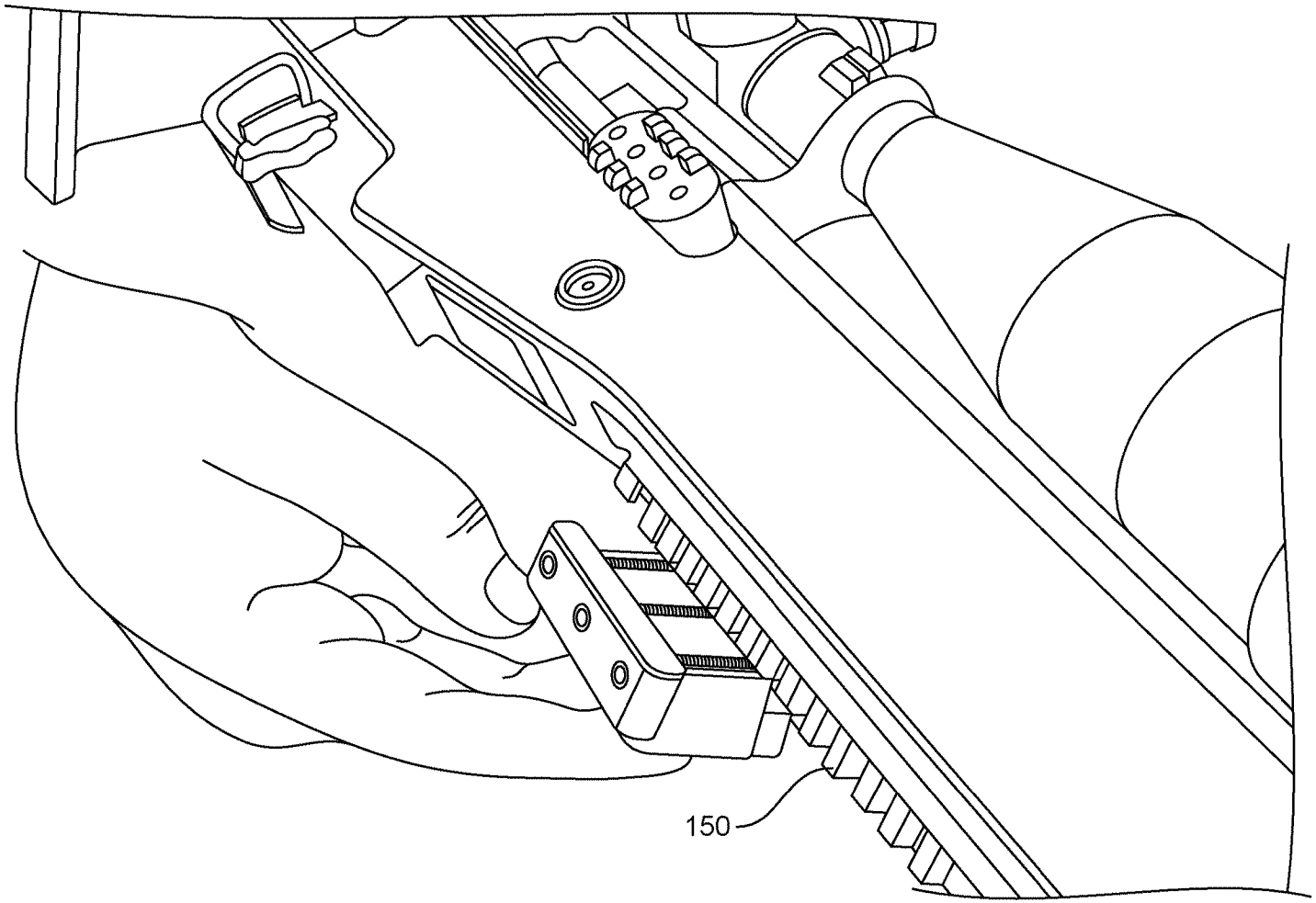
(Prior Art) FIG. 5
FIG. 5 illustrates the NATO Picatinny Dovetail Adapter of FIG. 2 being attached to a Picatinny rail.
Figure 6:
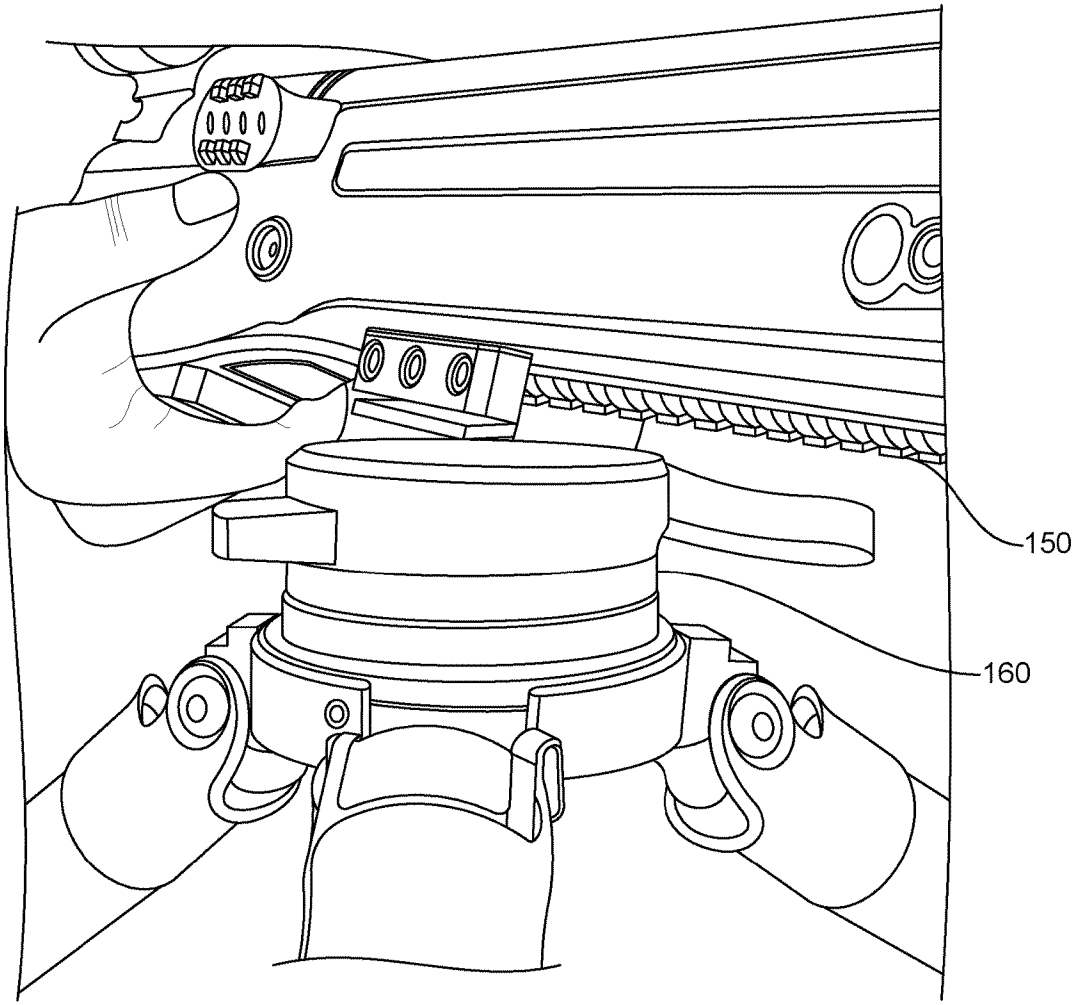
(Prior Art) FIG. 6
FIG. 6 illustrates the NATO Picatinny Dovetail Adapter of FIG. 2 attached to a Picatinny rail.
Figure 7:
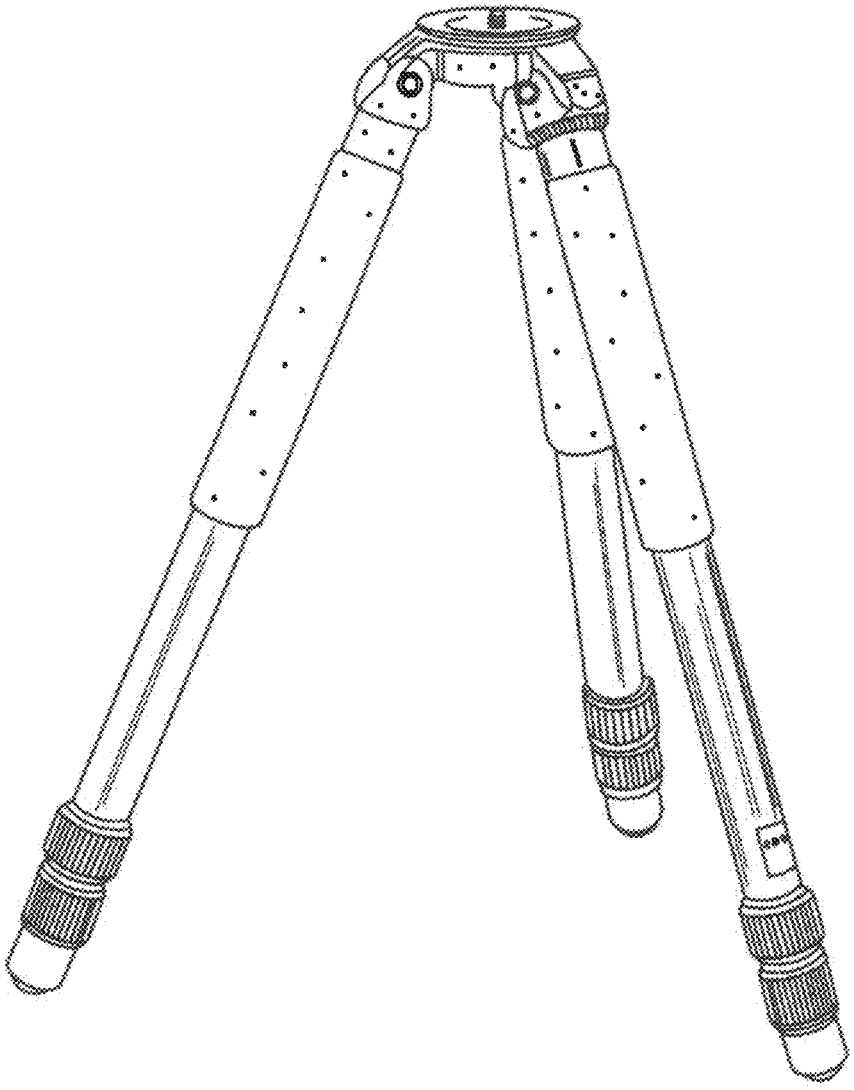
FIG. 7 PRIOR ART
FIG. 7 illustrates a tripod.

Referring to FIG. 7, in many situations it is desirable to have a stable, yet portable, support to permit a shooter to reliably take long and extreme long-distance shots (e.g., even beyond 1,000 yards). In many cases, it is desirable that the support is suitable for positioning a rifle of a shooter over two feet or more from the ground, preferably over three feet or more from the ground, and preferably at a height consistent with a standing position of the shooter from the ground. By positioning the support at an elevated height, the shooter is able to shoot over most obstacles without meaningfully compromising the stability of the system or otherwise meaningfully diminishing accuracy. One suitable type of support is a tripod that includes three legs, each of which may be moved inward and outward along an arc from an upper central region. In addition, each of the legs has an adjustable length so that the upper region may be leveled or otherwise oriented in any desired orientation. In addition, the upper region typically includes a threaded member, or otherwise, suitable to be attached to the base of an imaging device or a ball head. An exemplary tripod is illustrated in U.S. Pat. No. 8,398,037, incorporated by reference herein in its entirety. Other supports include, for example, a monopod or a bipod.

As previously described, shooting a rifle accurately, especially at long ranges, requires a very stable support system. Previously, the only ways to achieve a high level of stability was to use a bipod and lay in a prone position, or use a shooting bench and a rifle stand. As high stability tripods have been adopted into the long-range shooting community, plates with a standardized 1.5" dovetail for mounting the rifle chassis to quick release clamps on ball heads developed for photography and leveling bases developed for photography tend to be used. Ball heads, such as the Really Right Stuff BH-55, have reasonable control for articulation of the rifle while offering a relatively wide range of articulation, together with a reasonable level of lockup once a rifle needs to hold a specific position. Further, leveling bases, such as the Really Right Stuff TA-3-LC, tend to have even greater stability and lockup, but have limited articulation and control.

Ball heads developed for photograph and leveling bases designed for photography are generally insufficient for the particular demands of firearm shooting. It was determined that ball heads developed for photography have more customization and tuning adjustments than necessary for firearm shooting, and with all such customization and tuning tend to become confusing in high stress conditions such as firearm shooting. All the customization and tuning further tends to result in the locking mechanism tending for the ball to shift the rifle's point of aim. Moreover, the leveling base tends to lose lockup if forcing articulation in some situations, and can be difficult to operate with gloves or when the tripod is very low to the ground. In this manner, it is desirable to include the customization and tuning sufficient for firearm shooting that is non-confusing in high stress situations that also tends to reduce the likelihood of shifting the rifle's point of aim and also tends to reduce the likelihood of losing lockup during articulation.

Figure 8:
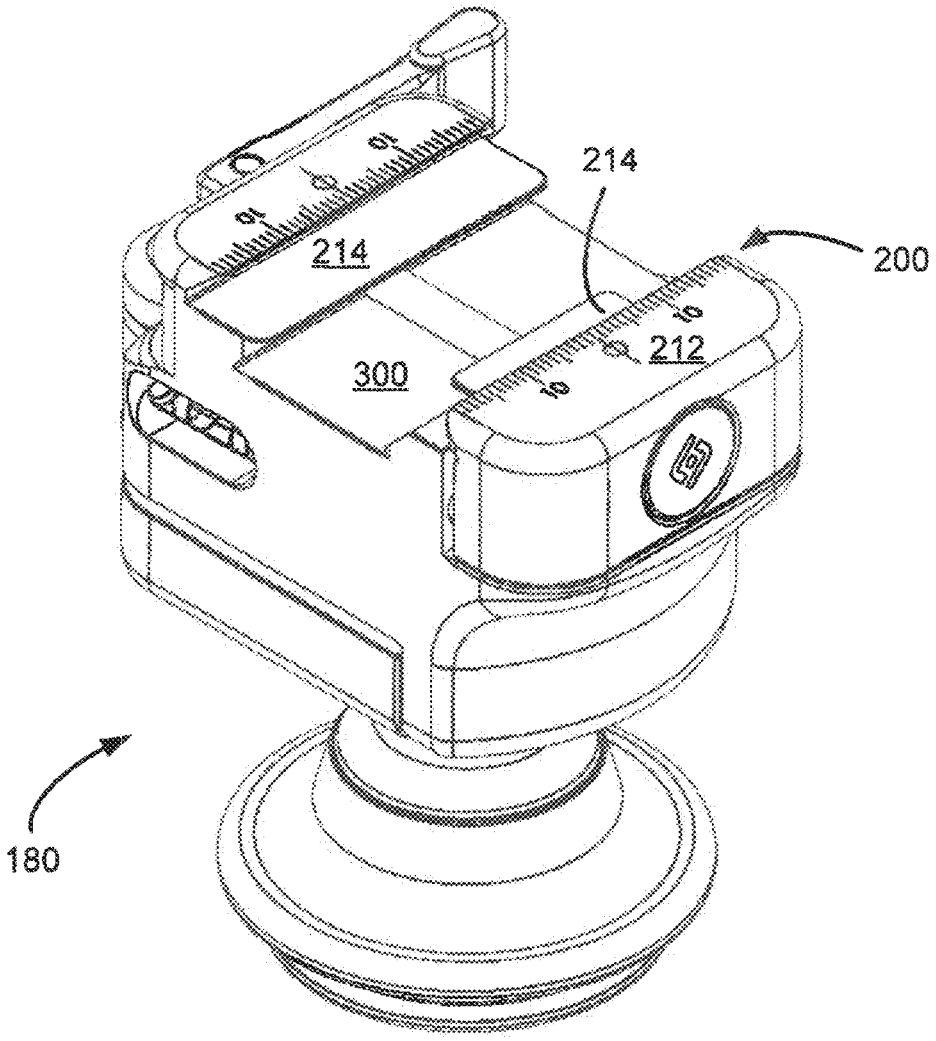
FIG. 8 illustrates an embodiment a ball head with a clamp assembly suitable to interconnect a dovetail plate of a camera and a Picatinny rail.
Figure 9:
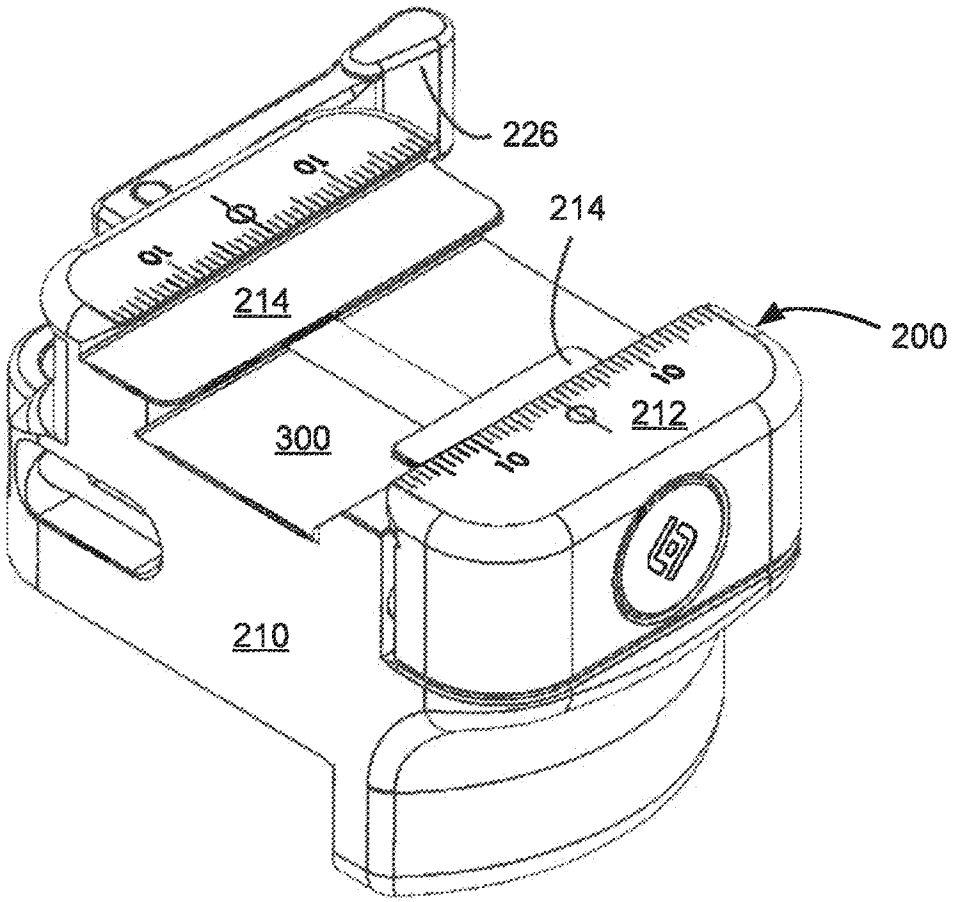
FIG. 9 illustrates a view the clamp assembly of FIG. 8.
Figure 10:
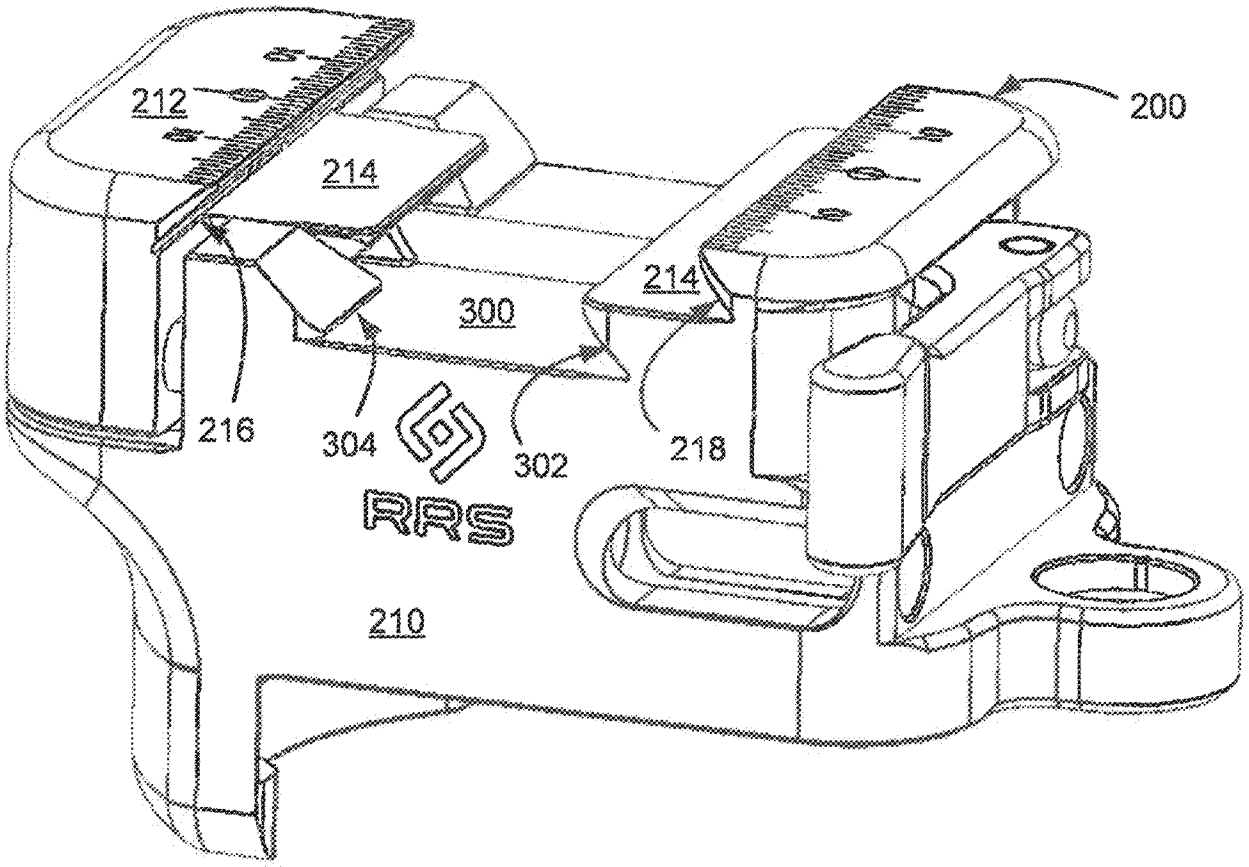
FIG. 10 illustrates another view of the clamp assembly of FIG. 8.
Figure 11:
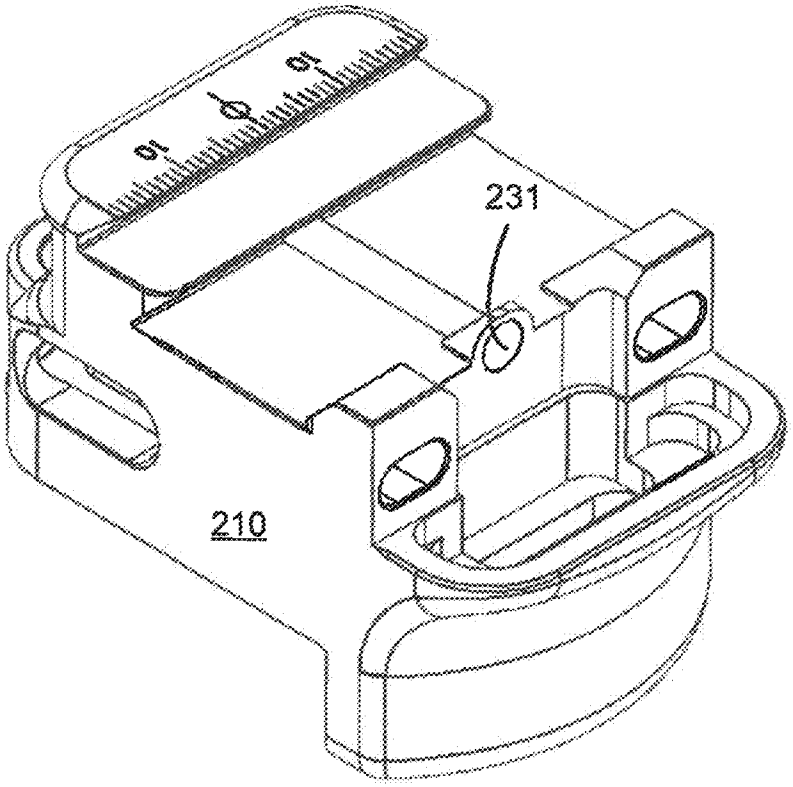
FIG. 11 illustrates an upper body of the clamp assembly of FIG. 8.
Figure 12:
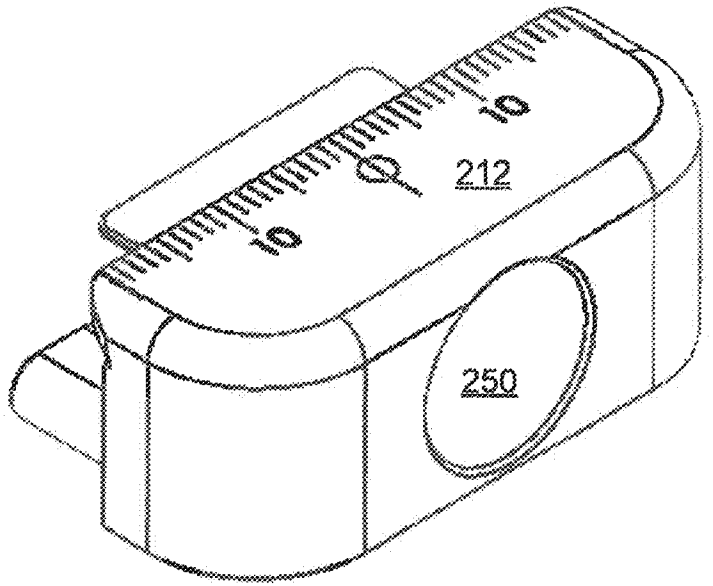
FIG. 12 illustrates an adjustable arm of the clamp assembly of FIG. 8.
Figure 13:
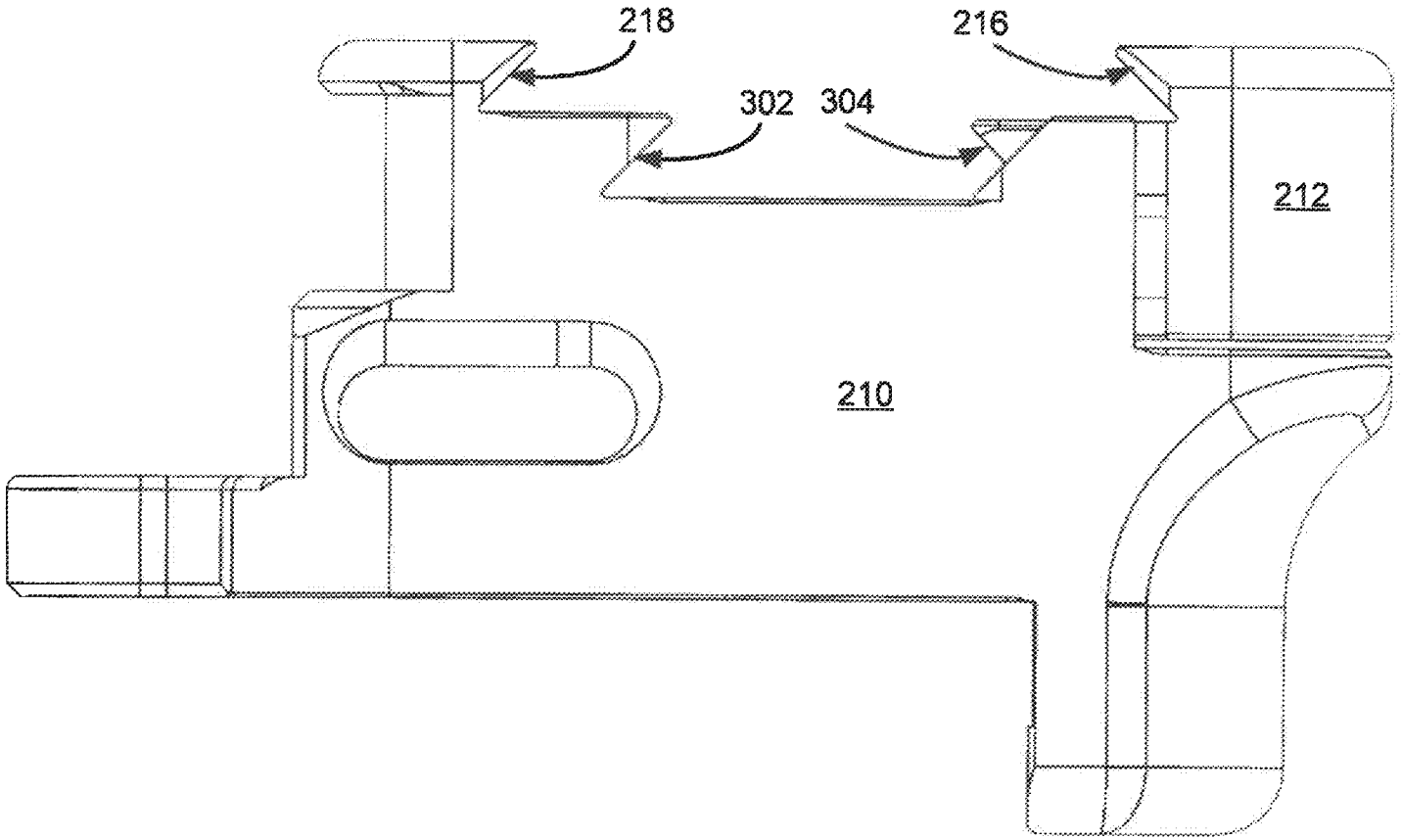
FIG. 13 illustrates a side view of the upper body and the adjustable arm of the clamp assembly of FIG. 8.
Figure 14:
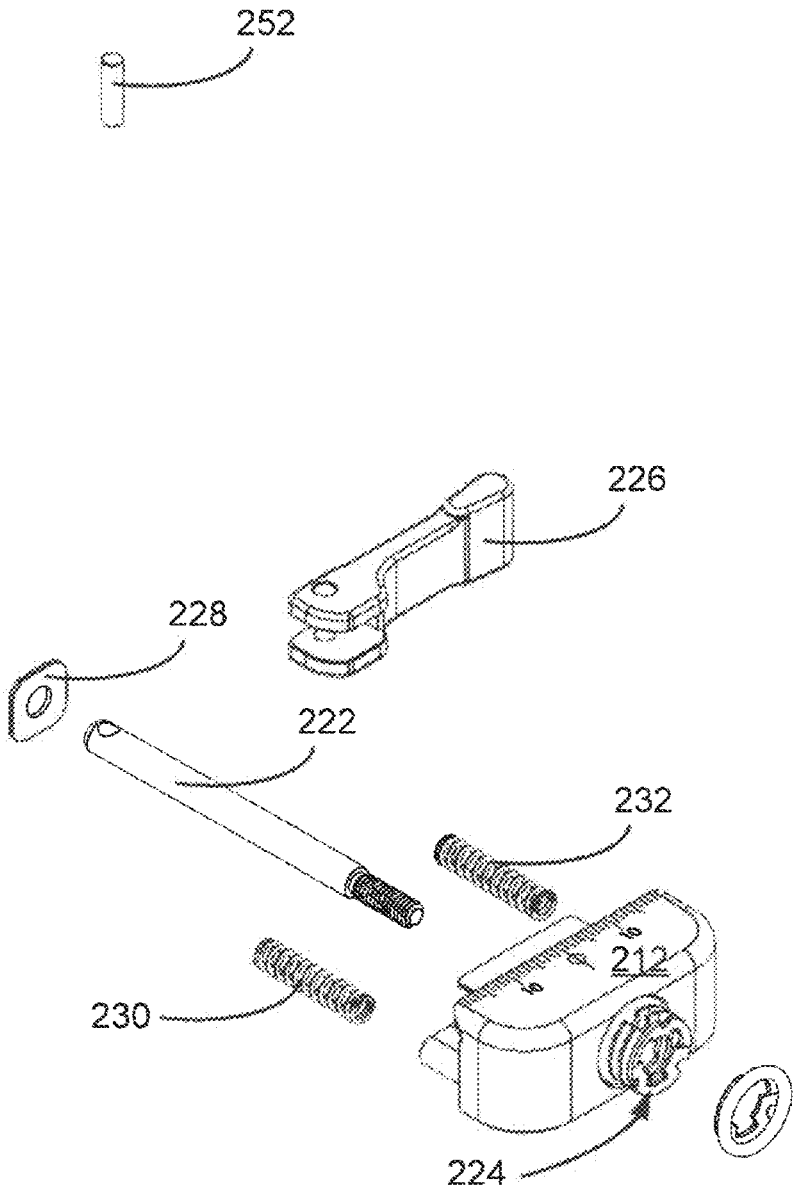
FIG. 14 illustrates an exploded view of a portion of the clamp assembly of FIG. 8.
Figure 15:
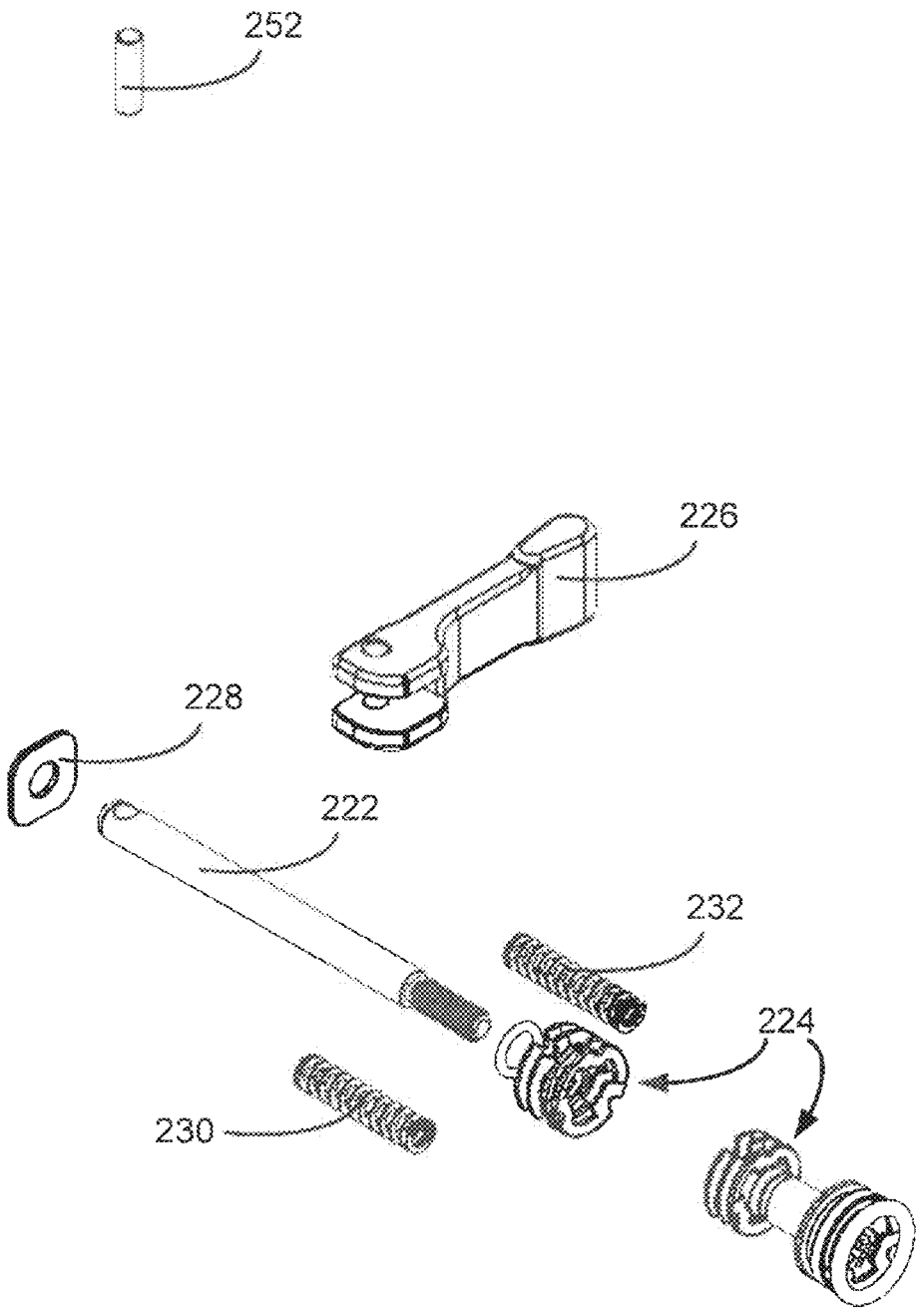
FIG. 15 illustrates an exploded view of a portion of the clamp assembly of FIG. 8.

Referring to FIG. 8, FIG. 9, and FIG. 10 a clamp assembly 200 is included as part of a ball head 180. Referring also to FIG. 11, the clamp assembly 200 includes an upper body 210 and referring also to FIG. 12 an adjustable arm 212 that together form an upper channel 214 having upper opposed side walls 216 and 218 (see FIG. 13). The upper channel 214 may include a pair of opposing supporting surfaces, which are part of the body 210 and/or part of the adjustable arm 212. Preferably, at least one of the supporting surfaces of the upper channel 214 extends less than half of the width of body 210 and is preferably substantially centered with respect to the adjustable arm 212. The body 210 is preferably integrated with a portion of the ball head 180. Referring also to FIG. 14 and FIG. 15, the adjustable arm 212 is slidably engaged along a stud 222 which is secured to a corresponding compression assembly 224 maintained within a cavity 250 (see FIG. 12) in the adjustment arm 212. The stud 222 is secured to a lever 226 together with a pin 252 extended through the stud 222 together with a washer 228, and arranged through an external opening 231 (see FIG. 11) in the upper base 210 and the external opening 250 in the adjustable arm 212 (see FIG. 12). The end of the stud 222 is secured to the compression assembly 224 in the adjustable arm 212. Rotation of the lever 226 selectively adjusts the width of the upper channel 214 and is accomplished through manual operation of the lever 226 fastened to the distal end of the stud 222. Alternatively, the adjustable spacing may be achieved with any other suitable structure.

The lever 226, operably attached to the adjustable arm 212, permits adjustment of the spacing between the side walls 216 and 218 so that the upper channel may selectively either grip or release a pair of grooves attached to a camera body (not shown). An exemplary set of grooves attached to a camera body is illustrated in U.S. Pat. No. 9,298,069, incorporated by reference herein in its entirety. Each respective side wall 216 and 218 is preferably angled upward and inward to facilitate engagement with such grooves. In this manner, photographic equipment may be quickly engaged or released from the clamp assembly by using the upper channel.

A pair of springs 230 and 232 may be interconnected between the body 210 (preferably retained in a depression) and the adjustable arm 212 (preferably retained in a depression) so that an outwardly directed force is exerted between the body 210 and the adjustable arm 212 to assist in maintaining the adjustable arm 212 in a suitable position. Other structures may be included that operably tend to exert an outward force on the adjustment arm with respect to the body. By way of example, the upper channel 214 may define a minimum channel that is generally a maximum of about 41 millimeters wide at the inside of the channel, generally about a minimum of 34 millimeters wide at the top of the side walls 216 and 218, with a height of generally about 4 millimeters, and an angle of substantially 45 degrees. Other channel sizes and structures may be used to correspond with the desired support structure for an imaging device.

In many situations, it is desirable to remove the camera being used to capture images of a scene from the clamp assembly and support a firearm together with a scope thereon to obtain a sharpened view of the particular scene. In many cases, the firearm includes a Picatinny rail on the lower surface thereof. To facilitate interconnection of the clamp assembly to the Picatinny rail, the clamp assembly preferably includes a lower channel, at an elevation lower than the upper channel, suitable for detachably interconnecting with the Picatinny rail.

The clamp assembly 200 includes the body 210 and the adjustable arm 212 that together form a lower channel 300 having lower opposed side walls 302 and 304. The lower channel 300 may include a supporting surface which is primarily defined by the body 210 and a portion of which may be defined by the adjustable arm 212, if desired. Preferably, the supporting surface of the lower channel 300 extends the width of body 210. The adjustable arm 212 is slidably engaged along the stud 222 which is secured to the corresponding compression assembly 224 in the adjustable arm 212. Movement of the adjustable arm 212 selectively adjusts the width of the lower channel 300 and is accomplished through manual operation of rotating the lever 226 fastened to the distal end of the stud 222. The lever 226, attached to the adjustable arm 212, permits adjustment of the spacing between the side walls 302 and 304 so that the lower channel may selectively either grip or release one or more rails attached to the base of a firearm. Each respective side wall 302 and 304 includes a portion of which is preferably angled upward and inward to facilitate engagement with such rails. The lower channel 300 also preferably defines a raised central portion, which may be defined by the stud 222 or any other structure, which preferably has a width suitable to be positioned between a pair of rails of the Picatinny rail. In this manner, the raised central portion will tend to inhibit the clamp sliding with respect to the Picatinny rail because the raised central portion will come into contact with one of the rails of the Pictinny rail. The adjustment mechanism may be achieved using an off-centered shaft, and may be more than one off-centered shafts and/or one or more centered shafts. Preferably, the shaft occupies the same region of space as the Picatinny clamp. The shaft may be positioned beneath the lower channel, if desired. As described, the shaft, which is preferably part of the adjustment arm adjustment mechanism, may be used to engage the grooves of the Picatinny clamp to prevent shifting of the clamp under loaded conditions. Alternatively, other structures may be used for engagement with the grooves of the Picatinny clamp, such as one or more pins or protruding features. In this manner, firearms may be quickly engaged or released from the clamp assembly by using the lower channel.

Figure 16:
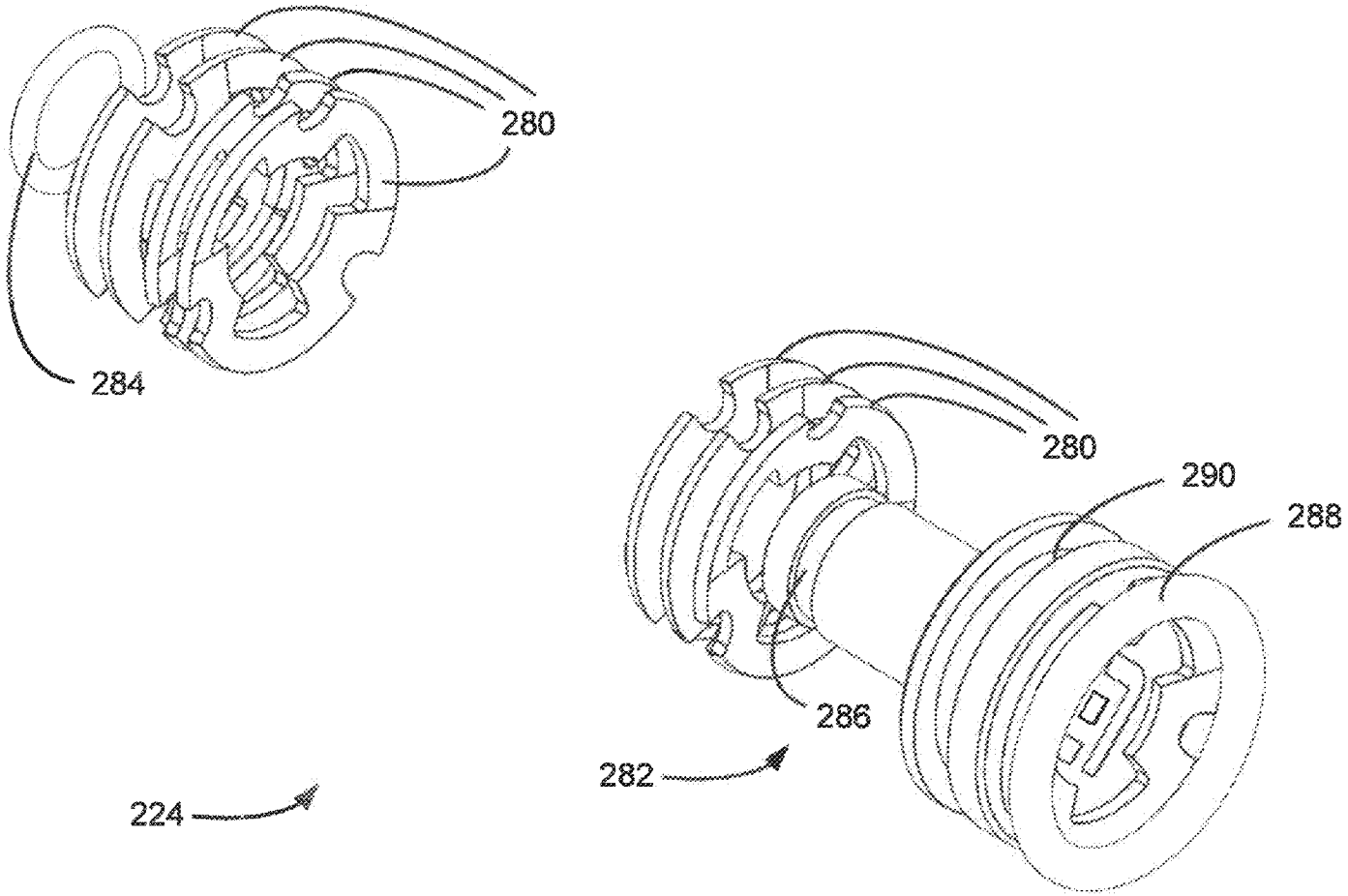
FIG. 16 illustrates an exploded view of a compression assembly of the clamp assembly of FIG. 8.

Referring to FIG. 16, the compression assembly 224 may include one or more compression members 280, such as Belleville spring washers and/or disc springs. The amount of compression may be varied by changing the orientation of one or more of the compression members 280. The compression members 280 may be maintained on a threaded end member 282 by a resilient rubber washer 284 maintained in a groove 286. The compression assembly 224 may be maintained centered within the cavity 250 by another resilient rubber washer 288 maintained within another groove 290. In this manner, the compression assembly 224 includes one or more compression members that are centered on the compression assembly 224 while being aligned with the stud 222 and the compression assembly 224 is centered within the cavity 250 while being aligned with the stud 222.

The lever 226 is preferably a cam lever that includes a cam portion that rotates about a pivot axis as the cam lever is moved between a first, unlocked position, and a second, locked position. The cam portion has an asymmetrical shape about the pivot axis so that the lever pushes the adjustable arm inward as the lever is moved from a first position for releasing equipment from the clamp to a second position for gripping equipment to the clamp. Conversely, as the lever is moved from the second position to the first position, the pair of counterforce springs, housed within the body, push outward on the adjustable arm so that the channel expands.

The outwardly directed force applied by the springs on the adjustable arm is at a maximum when the lever is in the second position, i.e. when the channel is intended to grip equipment. The force applied by the springs therefore acts to undesirably loosen the grip on the equipment. The clamp, however, includes the compression assembly that prevents any outward movement of the adjustable arm that might otherwise result from the force applied by the springs. The compression assembly may preferably apply an inwardly-directed force on the adjustable arm that increases as the lever is moved from the first position towards the second position. The inward force applied on the adjustable arm by the compression assembly may preferably be greater than the outward force applied by the springs when the lever is in the second position. Also, the lever may preferably include an over-center detent position.

The lever in the first position, i.e. the released position the adjustable arm is spaced apart from the body by an applied force from the springs, thus widening the channel to allow the insertion or removal of equipment. The cam portion is oriented such that the compression assembly, which in this instance is a series of Belleville springs that act as a compression spring, is sufficiently relaxed so as to not apply a sufficient inward force on the adjustable arm to overcome the outward force of the springs. In this position, the cam portion preferably abuts the adjustment arm at a minimum distance from the pivot axis. As the lever is moved from the first position toward the second position, the cam portion pulls the compression assembly and the adjustable arm, inward. The compression assembly begins to compress to counterbalance the outward force of the springs applied to the adjustable arm as it moves inward.

In a first intermediate position where the lever has been moved to a position where the adjustable arm is flush with the body, the forces applied by the compression assembly and the springs counterbalance each other; further movement of the lever towards the second position, however causes the inward force applied by compression of the compression assembly to increase over that of the springs because the adjustable arm may not move any further while the compression assembly will continue to compress.

In a second intermediate position where the compression assembly is applying a maximum inward force on the adjustable arm where the cam portion preferably pulls the compression assembly at a maximum distance from the pivot axis. In this position, the inward force applied by the compression assembly to the adjustable arm is substantially greater than the outward force applied by the springs. Further movement of the lever toward either the first or second position will relax the compression assembly with respect to the maximum inward force as the distance from the pivot axis on which the compression assembly abuts the cam portion decreases.

In the second position, the lever is in an over-center detent configuration such that movement of the lever toward the first position will act to compress the compression assembly. Thus, the compression assembly resists movement of the lever toward the first position. Preferably, when in this position, the inward force applied by the compression assembly to the adjustable arm is still greater than the outward force applied by the springs. Alternatively, the two forces could be precisely counterbalanced. In this manner, the adjustable arm is locked into place because the springs do not apply a sufficient force to overcome that force applied by the compression assembly.

The compression assembly preferably applies a force to the adjustable arm and the lever that varies with the position of the lever. The force preferably increases as the lever is moved from the first position towards the second position. The force preferably reaches a maximum before the lever reaches the second position. More preferably, the force applied by the compression assembly is less than that maximum when in the second position, so that the force applied by the compression assembly also increases as the lever is moved from the second position towards the first position. As the lever is moved over a range of motion extending from the first position to the second position, the force increases to a maximum at a second intermediate position and then decreases as the lever continues to the second position.

The adjustable arm may cease its inward motion at a first intermediate position before the compression assembly has reached its maximum force. This may be preferable so that the inward force applied by the compression assembly on the adjustable arm, when the lever is in the second position, can still overcome the outward force applied by the springs even though the force applied by the compression assembly has fallen from its maximum. It should be further noted that the movement of the adjustable arm corresponds to the movement of the lever. Therefore, it is desirable that the lever move through a large percentage of it range of motion before the adjustable arm ceases to move, and achieve a maximum force in the remaining range of motion of the lever. For that reason, the force applied by the compression assembly in the clamp achieves its maximum value at approximately 80-90% of the lever's range of motion. It should be understood, however, that other embodiments may achieve a maximum force anywhere along the lever's range of motion, but preferably greater than 50%.

As the lever is moved from the first position, the force increases continuously to a maximum and decreases continuously until the lever reaches the second position. Alternative embodiments may design a lever that permits the force profile to decrease at certain intervals on the lever's path from the first position to the second intermediate position of maximum force, or to increase on the lever's path from that second intermediate position to a lesser force at the second position, or both. Preferably, however, the force profile is increasing over at least 65% of the lever's path from the first position to the second intermediate position and is decreasing over at least 65% of the path from the second intermediate position to the second position.

As previously described, the clamp assembly 200 with a "stationary" body together with a moving adjustment arm defines the upper clamp that is preferably compatible with Really Right Stuff™ and Arca-Swiss style dovetails. As previously described, the clamp assembly 200 with a "stationary" body together with a moving adjustment arm defines the lower clamp that is preferably compatible with the Pictinny rail. With separate structures at different elevations within the same clamp assembly facilitates a compact clamp assembly that defines a pair of adjustable spacing structures.

Figure 17:
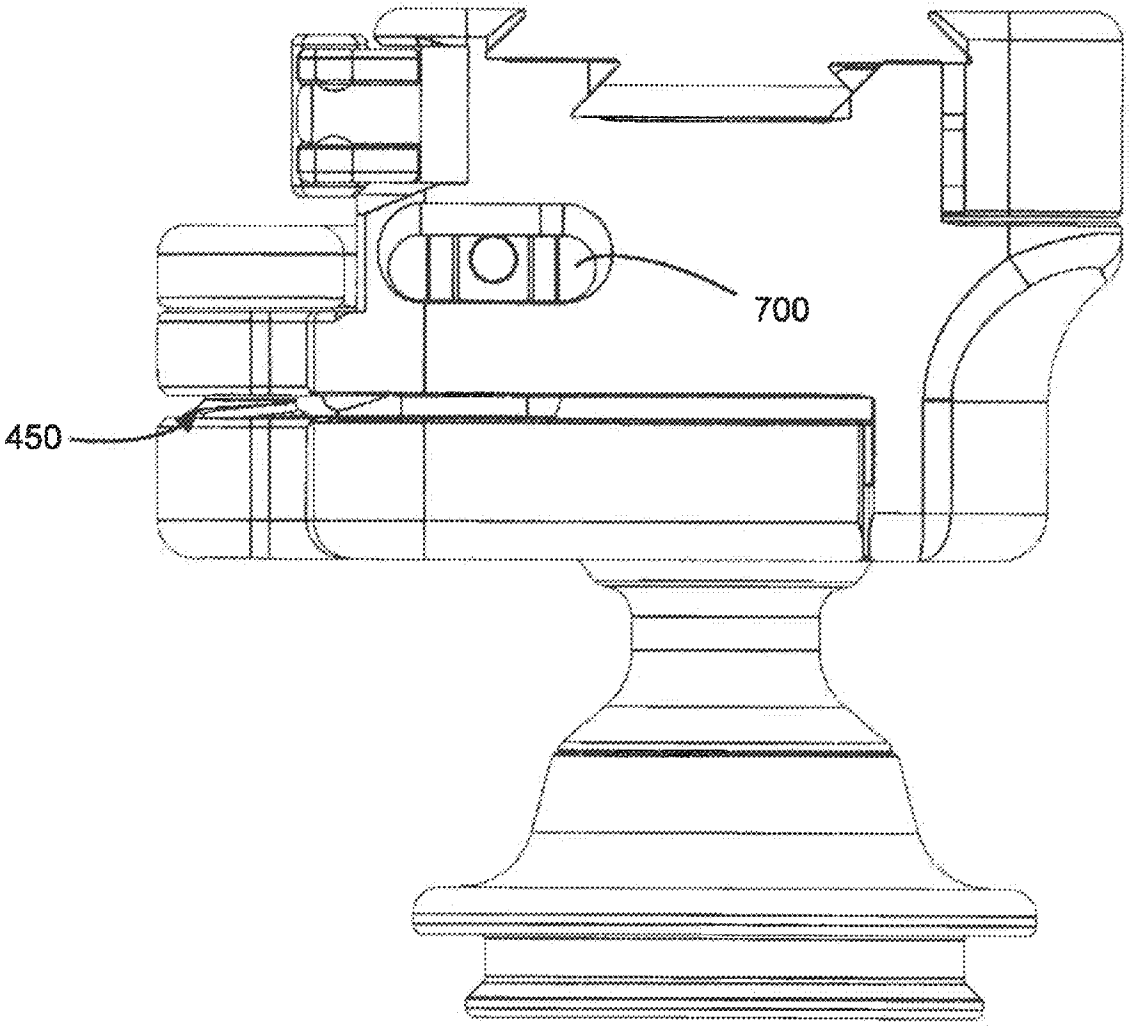
FIG. 17 illustrates a front view of the ball head of FIG. 8.
Figure 18:
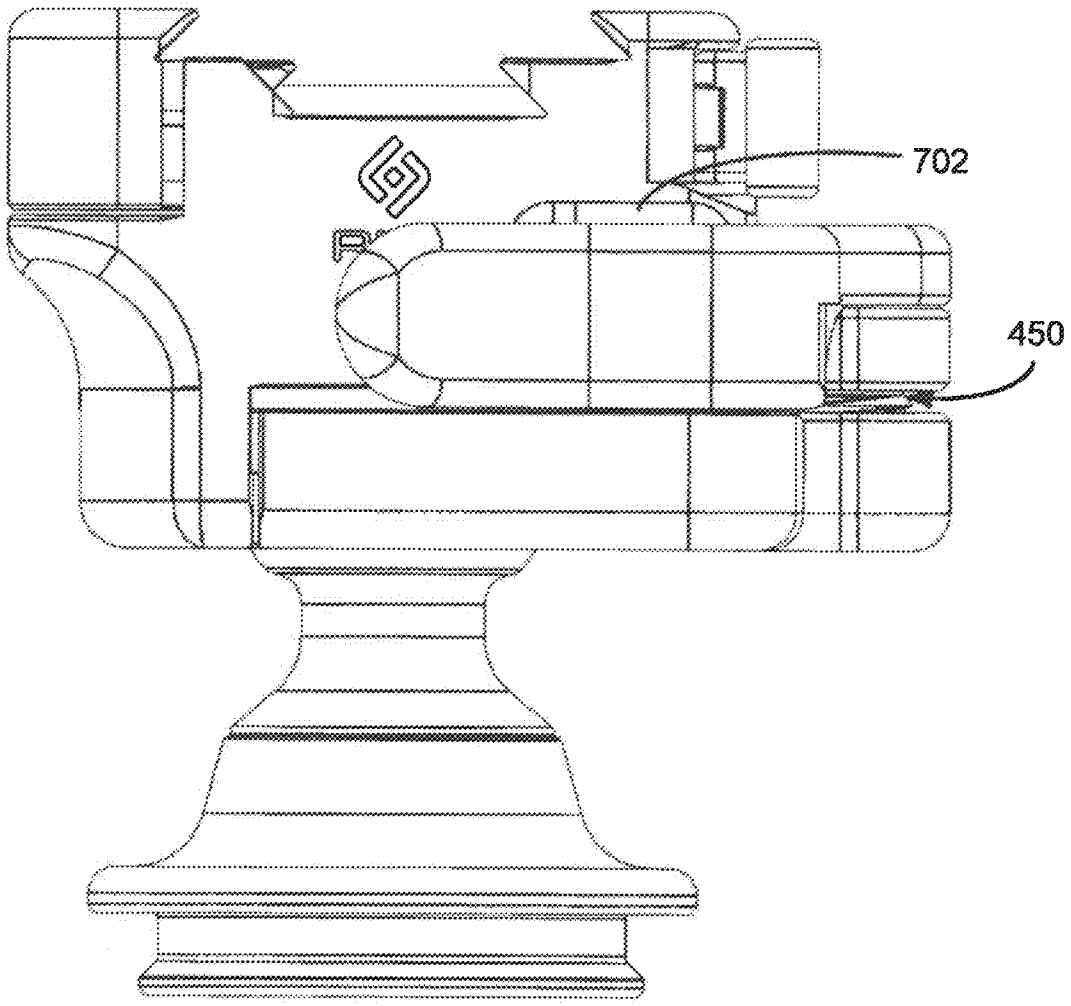
FIG. 18 illustrates a back view of the ball head of FIG. 8.
Figure 19:
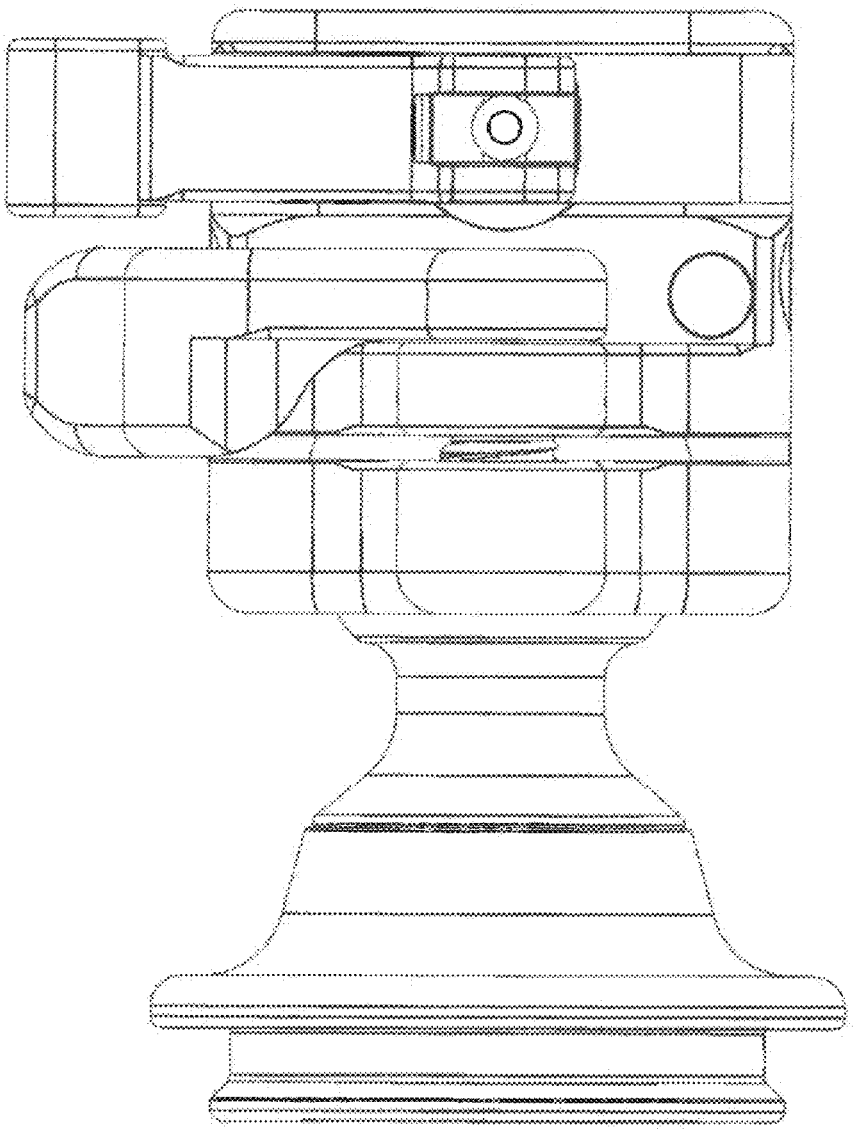
FIG. 19 illustrates a left view of the ball head of FIG. 8.
Figure 20:
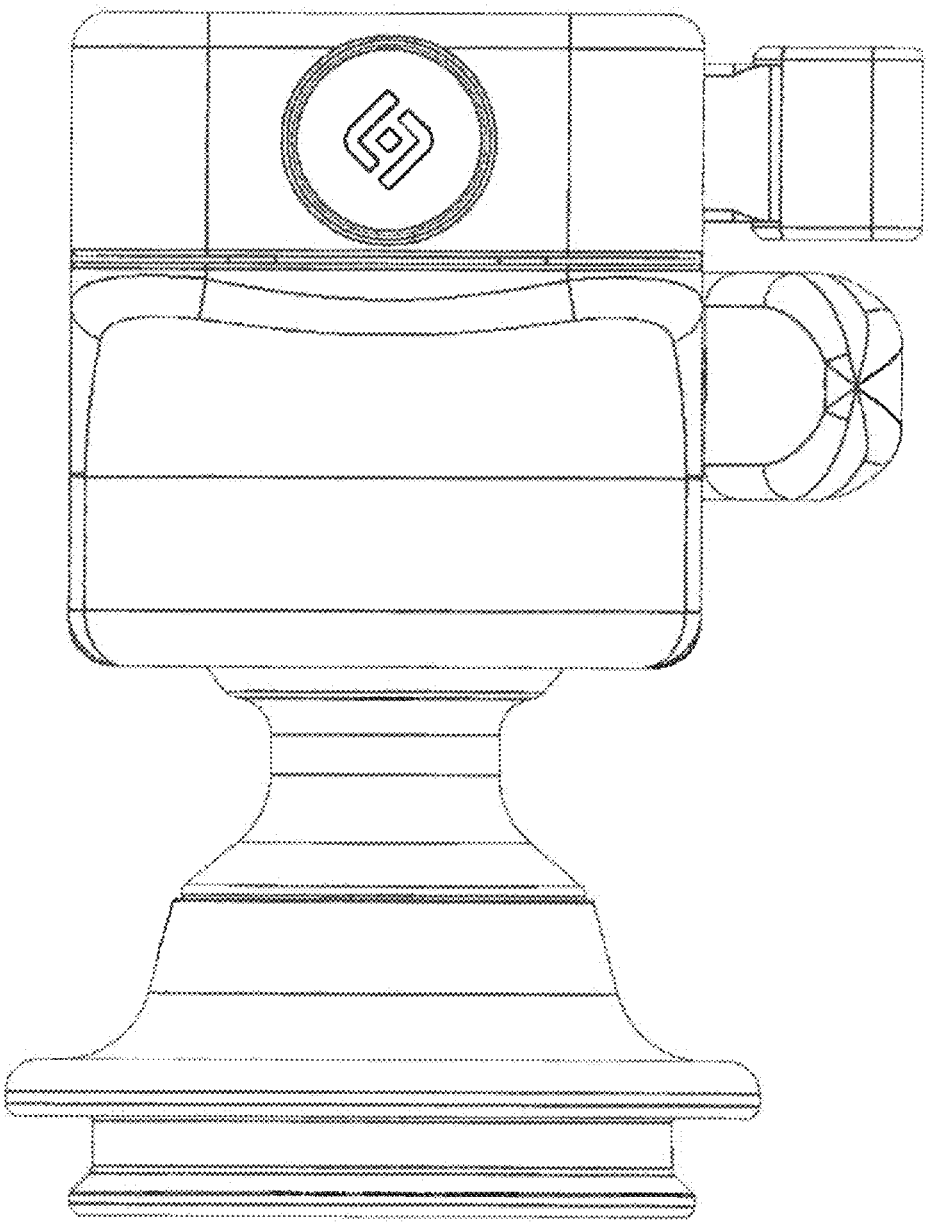
FIG. 20 illustrates a right view of the ball head of FIG. 8.
Figure 21:
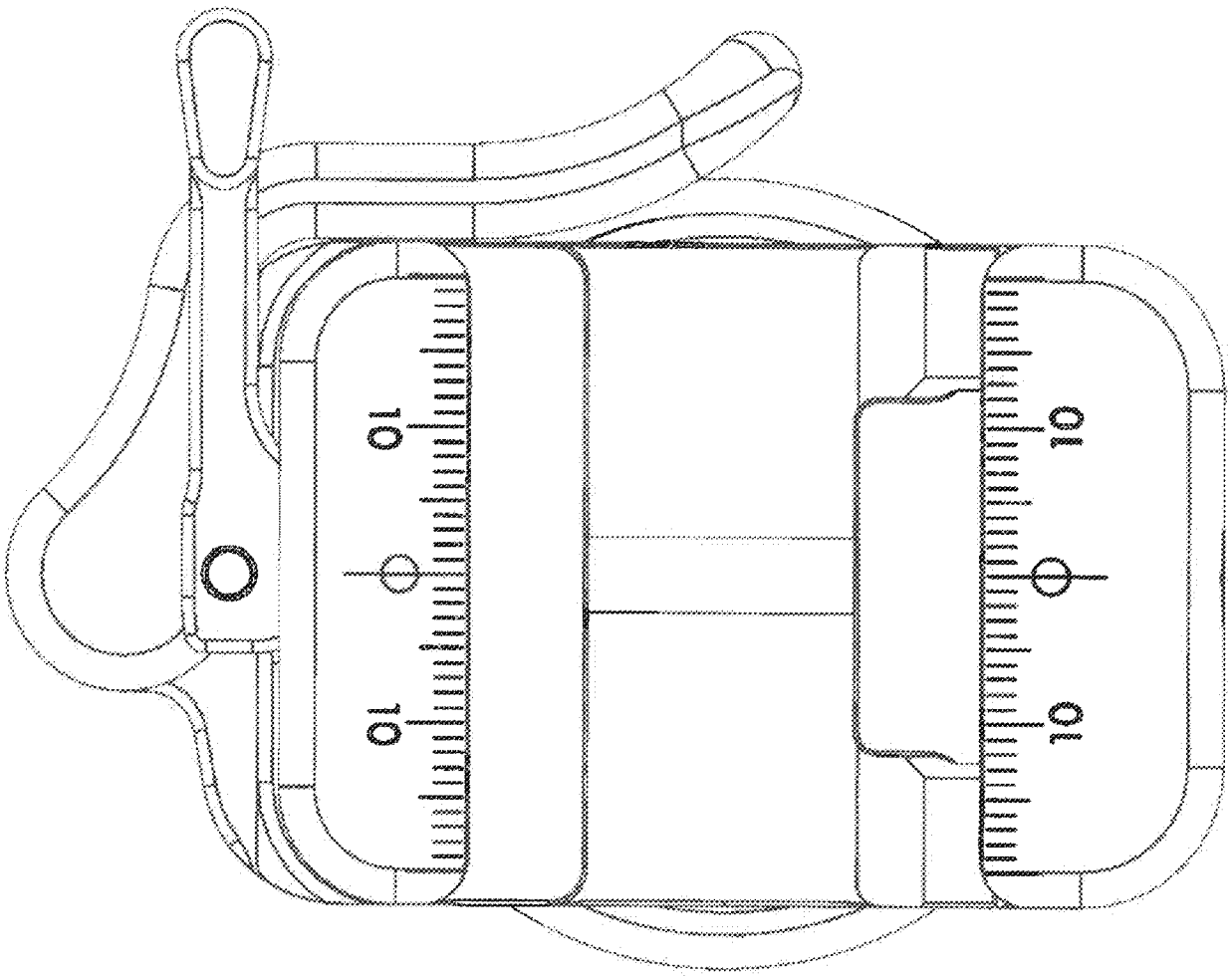
FIG. 21 illustrates a top view of the ball head of FIG. 8.
Figure 22:
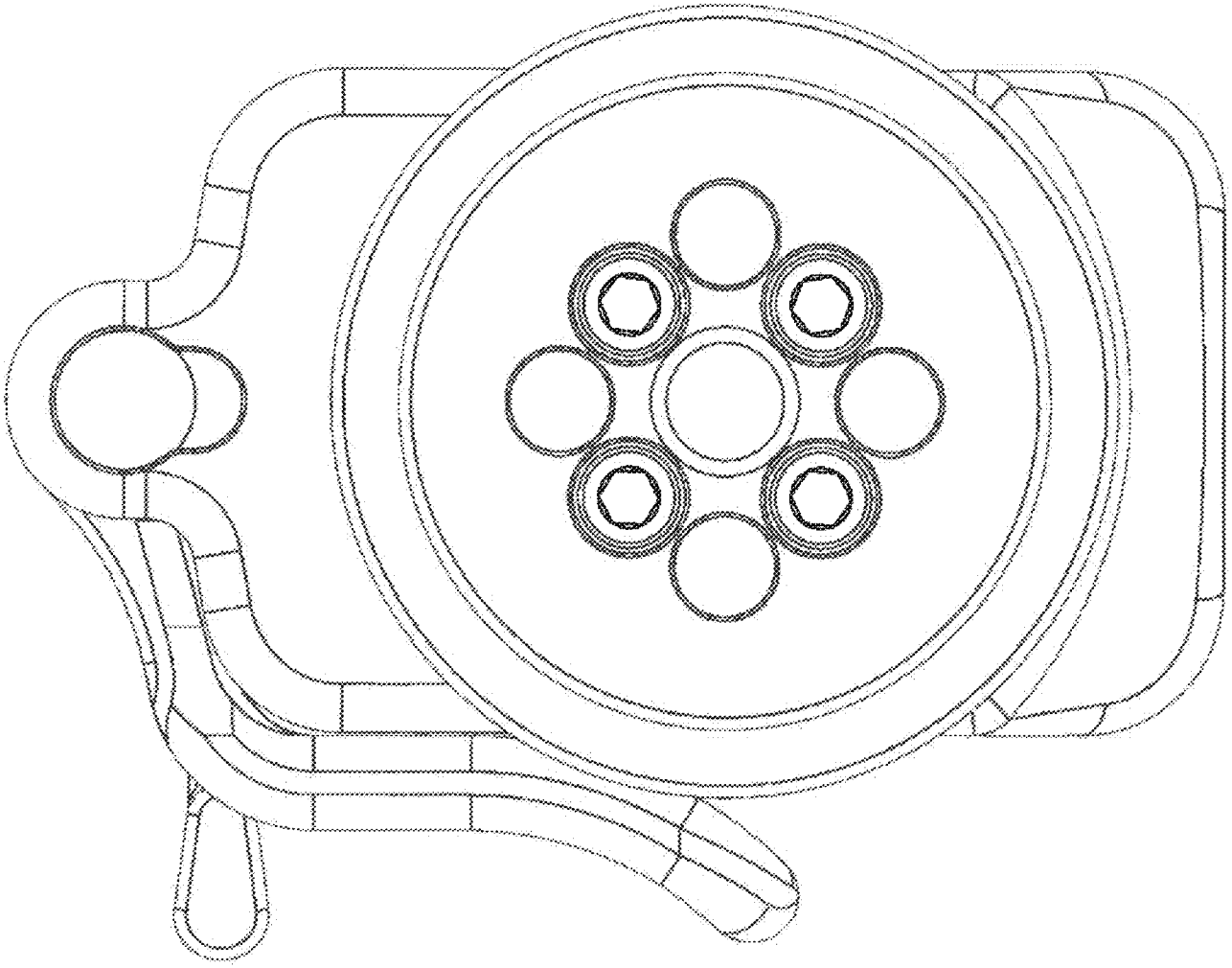
FIG. 22 illustrates a bottom view of the ball head of FIG. 8.

Referring to FIG. 8 (perspective view), FIG. 17 (front view), FIG. 18 (back view), FIG. 19 (left view), FIG. 20 (right view), FIG. 21 (top view), and FIG. 22 (bottom view), the ball head 180 has the general appearance of being an upside down ball head that includes a locking mechanism that is suitable for high stress shooting conditions that also reduces the point of aim shift. The ball head 180, which includes a ball therein, has an operation where the clamp assembly 200 is freely movable to a substantial level of lockup as a result of moving a lever. The lockup on the ball is preferably comparable to that of leveling bases while improving accessibility and allowing on-the-fly adjustments to the lockup, if desired, without losing lockup during articulation.

Figure 23:
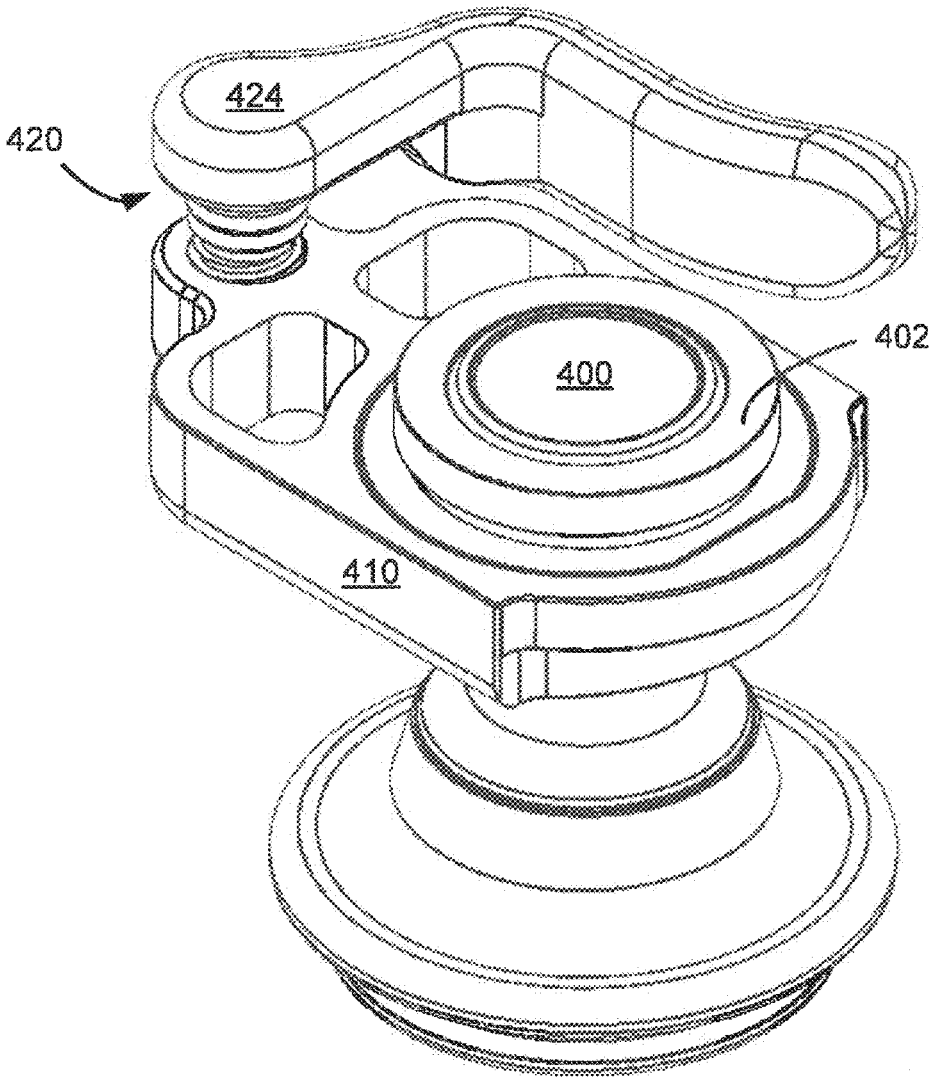
FIG. 23 illustrates a lower portion of the ball head of FIG. 8 that includes a locking mechanism.
Figure 24:
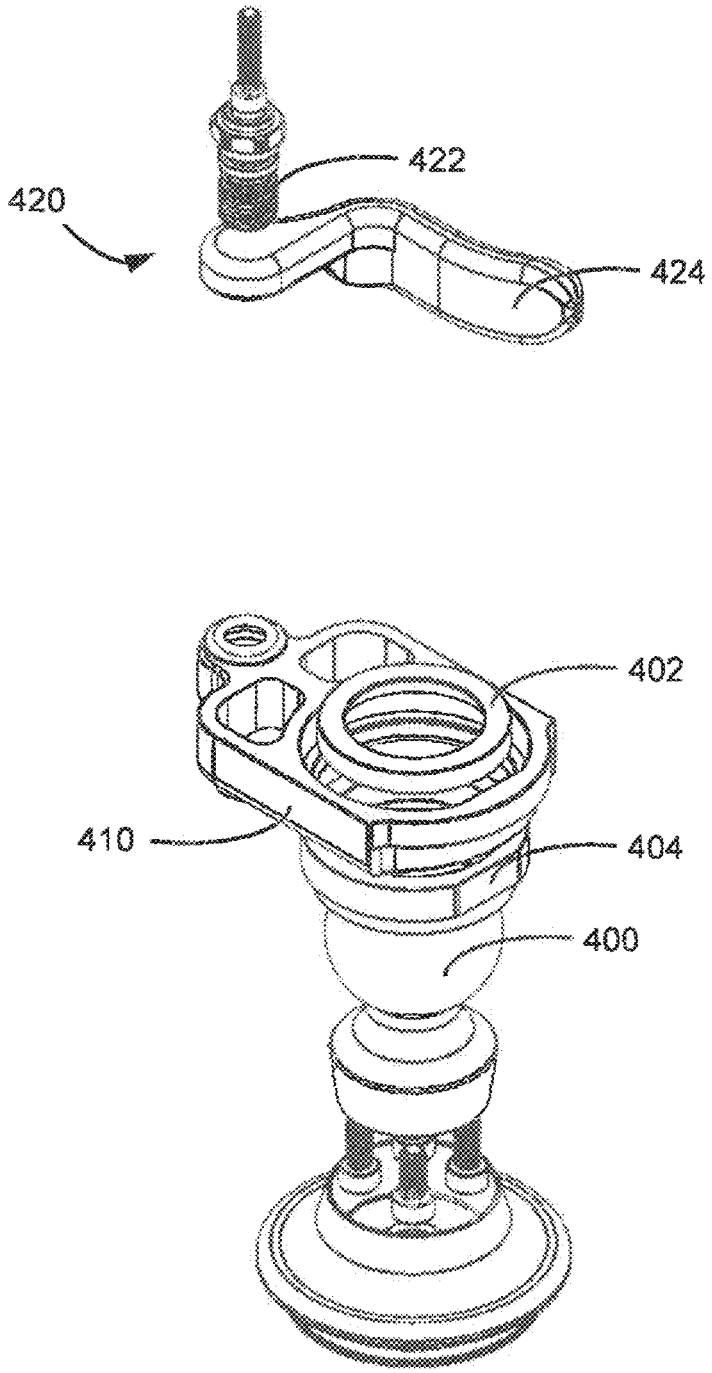
FIG. 24 illustrates an exploded view of lower portion of the ball head of FIG. 8 that includes a locking mechanism.
Figure 25:
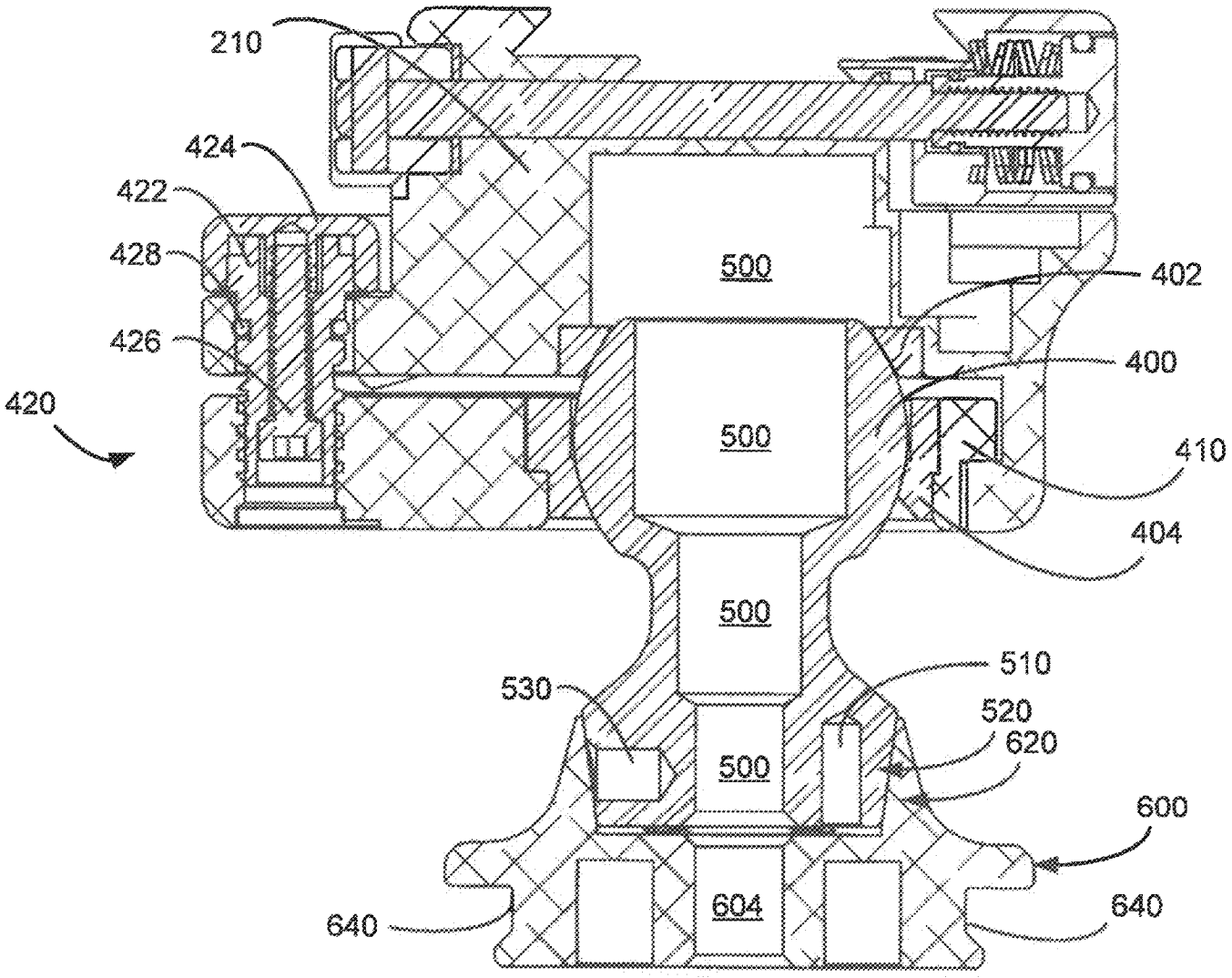
FIG. 25 illustrates a cross sectional view of ball head of FIG. 8.
Figure 26:
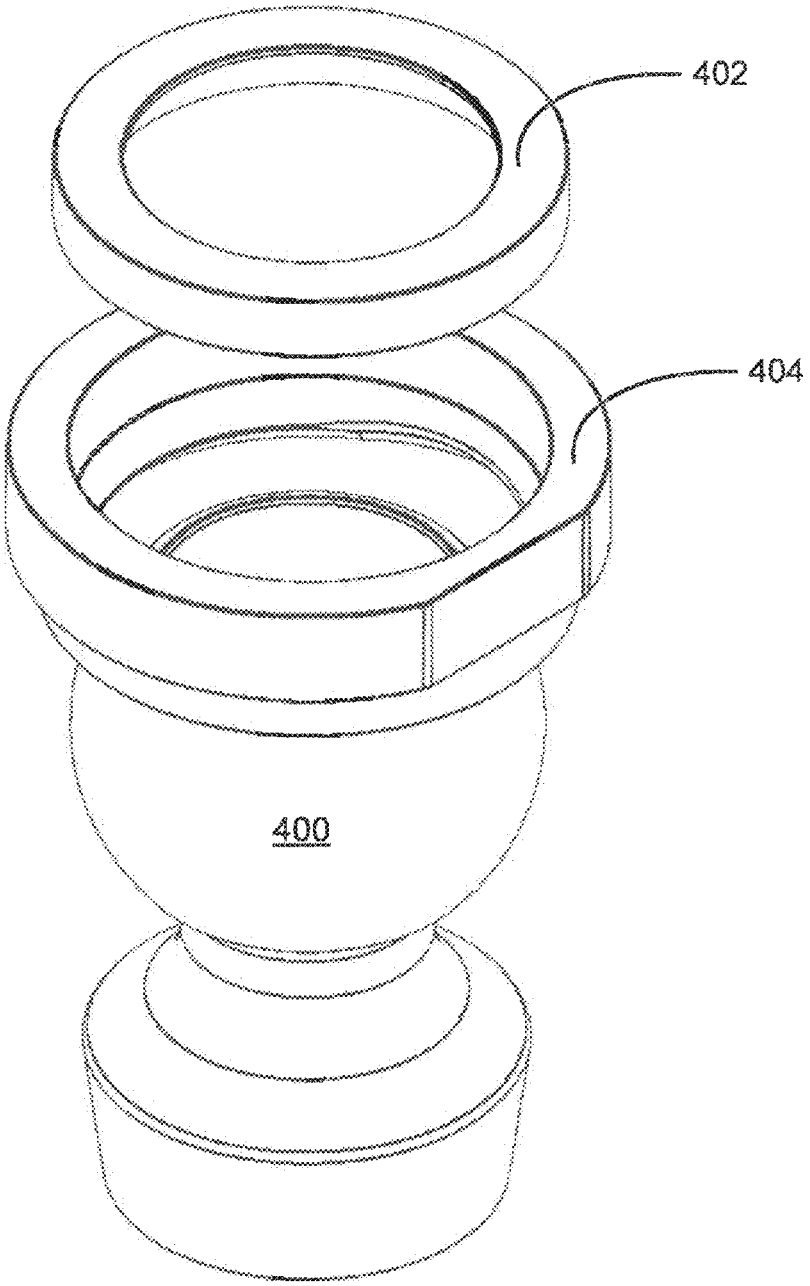
FIG. 26 illustrates an exploded view of a center ball together with upper and lower rings.

Referring also to FIG. 23, and FIG. 24, the ball head 180 includes a clamp-shell that incorporates a locking mechanism. The locking mechanism includes a central ball 400 with an upper ring 402 and a lower ring 404. Referring also to FIG. 25 and FIG. 26, the upper ring 402 is in pressing face-to-face engagement with the upper portion of the central ball 400 by the upper base 210 which is supported thereon. With the rifle supported on the clamp assembly 200, it provides a pressing engagement at all times that presses the upper ring 402 onto the central ball 400, thereby providing a solid and continual engagement. This solid and continual engagement reduces, if not otherwise substantially eliminate, the point of aim shifting that would otherwise occur when the locking mechanism is secured. The locking mechanism is secured by drawing up the lower ring 404 to be wedged in pressing face-to-face engagement against the lower portion of the central ball 400, together with the upper ring 402 being wedged against the central ball 400.

Figure 27:
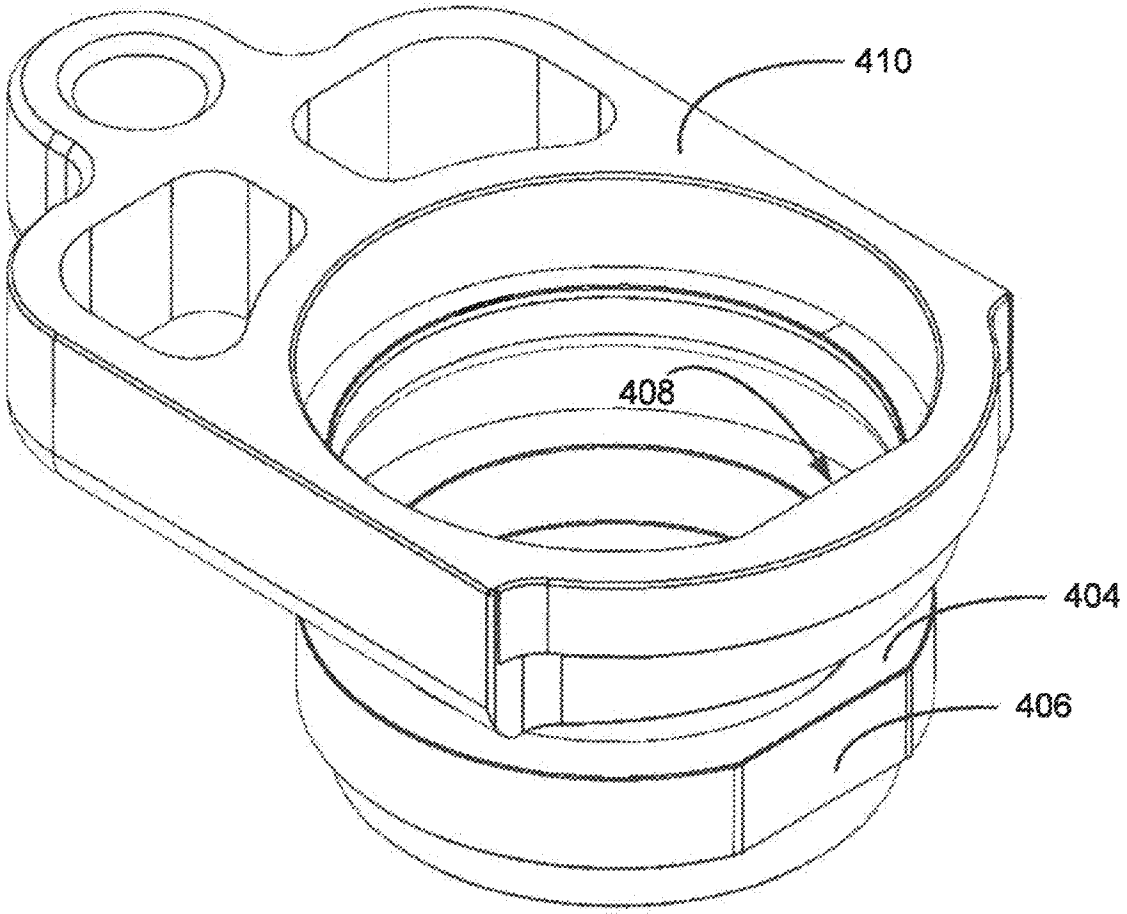
FIG. 27 illustrates an exploded view of the lower plate and lower ring.

Referring also to FIG. 27, the lower ring 404 is pressed into, or otherwise secured, to a lower base 410. The lower ring 404 and lower base 410 may include respective flattened portions 406, 408 that inhibit relative rotation. The lower base 410 is pulled up to form the locking mechanism together with the upper base 210 by a screw mechanism 420. The screw mechanism 420 includes a clamping screw 422 with a broached serrated head which matches a broached pocket inside a lever 424. The lever is pulled down to engage the clamping screw 422 with an internal screw 426 that is threaded within the lever 424. By rotating the lever 424 counterclockwise, the clamping screw 422 likewise rotates counterclockwise, which includes threads that rotate with respect to matching threads of the lower base 410, thereby increasing the separation between the lower base 410 and the upper base 210. By rotating the lever 424 clockwise, the clamping screw 422 likewise rotates clockwise, which includes threads that rotate with respect to matching threads of the lower base 410, thereby decreasing the separation between the lower base 410 and the upper base 210. As it may be observed, the lower base 410 is pulled up toward the upper base 210 as part of the locking mechanism, which reduces, if not otherwise substantially eliminates, the point of aim shifting. Referring also to FIG. 17 and FIG. 18, a timing broach 450 is adjustable with respect to the screw mechanism 420 to adjust the lockup of the locking mechanism.

To change the tension range of the lever 424, the inner screw 426 may be loosened and removed to allow the lever 424 to be lifted, rotated, and then re-engaged with the clamping screw 422. This permits the lever 424 to be repositioned to change the torque that is applied to the clamping screw 422 at the lockup of the central ball 400. In this manner, the lever 424 may be used as an "on" and "off" switch to change between a maximum and a minimum lockup desired by the user. The clamping screw 422 may include an O-ring 428 to reduce self-loosening under heavy recoil.

The ball head 180 includes a clamp assembly 200 that is rotatable while the lever 424 is released with a limited amount of tilt, such as less than +/−40 degrees, and preferably less than +/−30 degrees of tilt, and more preferably less than +/−20 degrees of tilt. Also, the ball head 180 includes the clamp assembly 200 that is not rotatable while the lever 424 is engaged. The lever 226 of the clamp assembly 200 may be rotated in a clockwise direction to engage the jaws of the clamp assembly 200 to secure a device therein. Also, lever 226 of the clamp assembly 200 may be rotated in a counter-clockwise direction to engage the jaws of the clamp assembly 200 to secure a device therein. The capability of rotating the lever 226 selectively in either a clockwise or a counter-clockwise direction to engage the jaws of the clamp assembly 200 permits the user to select the direction of rotation that is most comfortable for them. In addition, the capability of rotating the lever 226 selectively in either a clockwise or a counter-clockwise direction accommodates users regardless of whether they are right hand dominant or left hand dominant.

Figure 28:
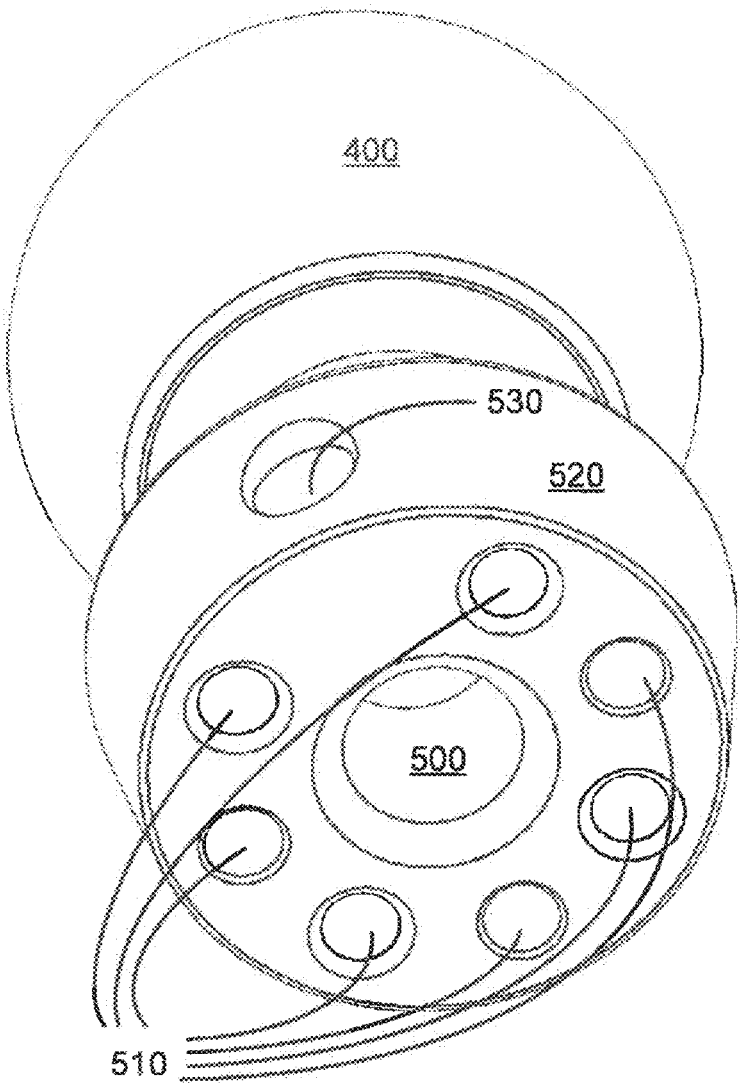
FIG. 28 illustrates a lower view of the center ball.
Figure 29:
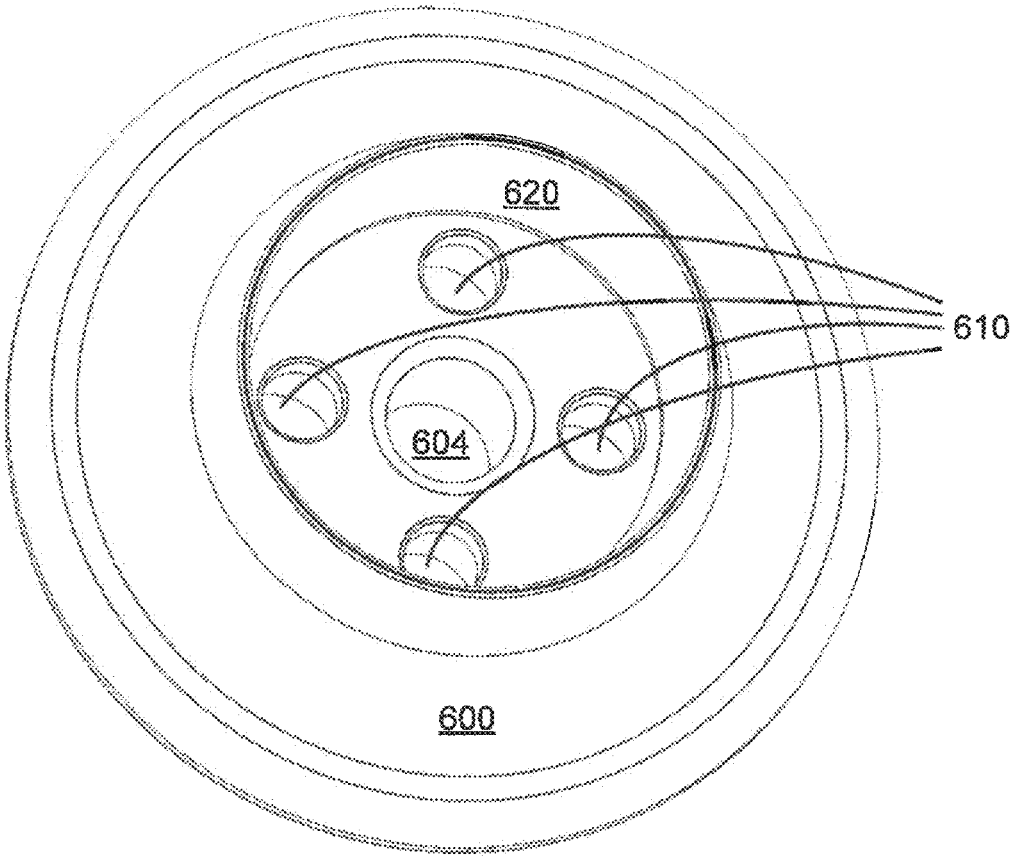
FIG. 29 illustrates an upper view of an adapter.
Figure 30:
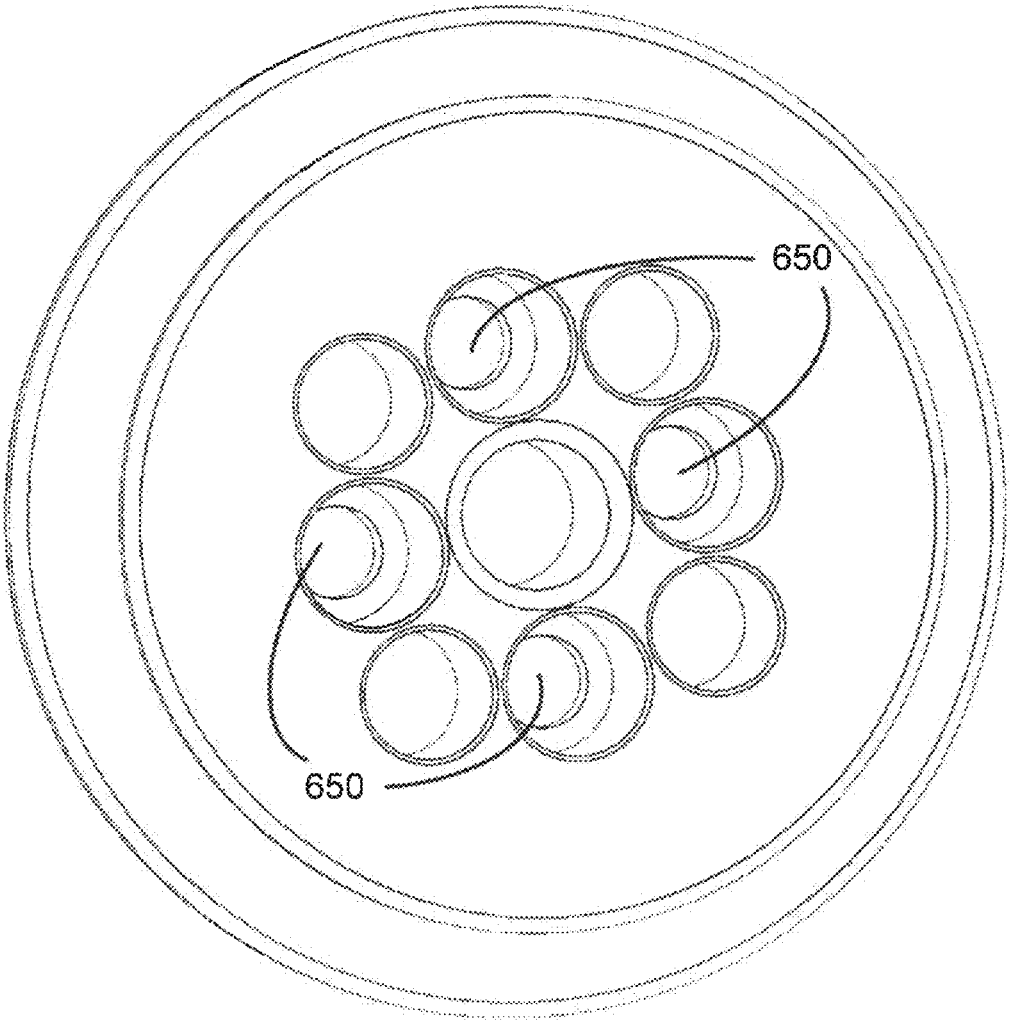
FIG. 30 illustrates a lower view of the adapter.

The stem of the central ball 400 defines a hole 500 extending all the way through the central ball 400 for a stud (e.g., a threaded stud) passing therethrough for mounting the top of a tripod. Referring also to FIG. 28, the stem of the central ball 400 also includes seven spaced apart holes 510 for bolting on an adapter 600. Preferably four of the holes 510 are threaded, but any number of the holes 510 may be threaded, as desired. Referring also to FIG. 29, the adapter 600 includes a corresponding set of holes 610, which are aligned with the holes 510, so that the adapter can be secured to the central ball 400 with a set of studs. Also, the adapter 600 includes a central opening 604 so that the central ball 400 may be secured to the top of a tripod with the adapter 600 being secured thereto. In addition, the adapter 600 defines a tapered portion 620 that matches a tapered portion 520 of the central ball 400. The tapered portions 520, 620 engage with one another in such a manner that form a secure arrangement. In addition, a cross-drilled threaded opening 530 may be included in the central ball. The adapter 600 also defines a pair of grooves 640 that are suitable for being detachably engaged with a quick release clamp. Referring to FIG. 30, the adapter 600 also defines another set of four threaded openings 650 that are suitable for being secured to the top of a tripod with a set of screws.

Referring again to FIG. 17 and FIG. 18, a pair of bubble level vials 700, 702 are included in the upper base 210 with an orientation that is parallel to the bottom interior supporting surfaces of the clamp assembly 200. The bubble level vials 700, 702 may include photo luminescent backing to provide light to see the bubble in poorly lit areas by quickly charging the backing material with a light source.

The lever 424 may be optionally modified to include a threaded stud on the end thereof. With a threaded stud on the end thereof, the user may select among a plurality of different knobs to be attached thereto. In this manner, different users may select different knobs, depending on their preferences.

Figure 31:
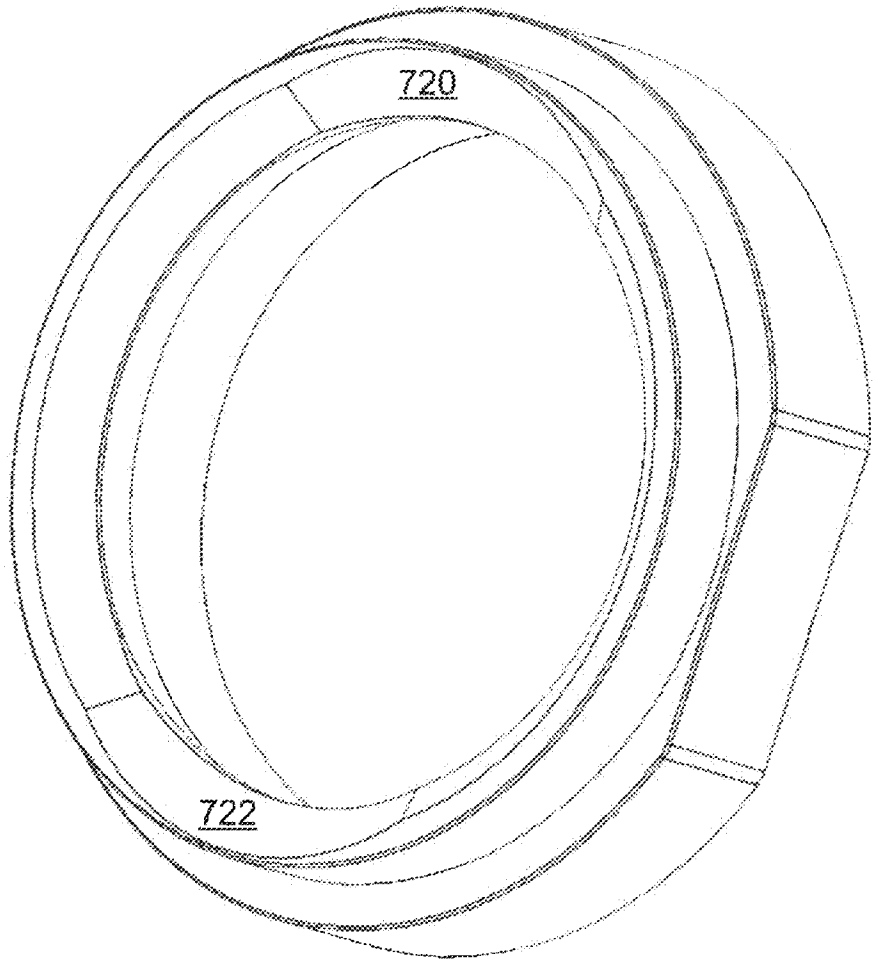
FIG. 31 illustrates a view of the lower ring including cutouts.

Referring to FIG. 31, the lower ring 404 may optionally include a pair of relief cuts 720, 722 defined therein, preferably positioned in the forward direction of tilt and positioned in the rearward direction of tilt, to allow the head to tilt to a greater degree in the forward and rearward directions.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for selectively engaging a plate for photographic equipment and a rail assembly for a firearm, said apparatus comprising:

(a) a body and an arm capable of lateral movement collectively defining an upper channel having a pair of sidewalls suitable to detachable engage a pair of angled edges of said plate;

(b) said body and said arm capable of lateral movement collectively defining a lower channel having a pair of sidewalls suitable to detachably engage a rail of said rail assembly;

(c) said body defining an upper body and defining an upper cavity, said body defining a lower body and defining a lower cavity;

(d) a base that includes a ball that is sized to be rotatably maintained within a cavity defined by said upper cavity and said lower cavity;

(e) said upper body and said lower body capable of vertical movement to selectively inhibit movement of said body with respect to said ball.

2. The apparatus of claim 1 further including a ball adjustment member that movement of which said selectively inhibits movement of said body with respect to said ball.

3. The apparatus of claim 2 wherein said ball adjustment member comprises a lever that said selectively inhibits movement of said body with respect to said ball from freely movable to a substantial level of lockup.

4. The apparatus of claim 3 wherein said apparatus includes an upper ring that is in pressing engagement with an upper portion of said ball and in pressing engagement with said upper cavity.

5. The apparatus of claim 4 wherein said apparatus includes a lower ring that is in pressing engagement with a lower portion of said ball and in pressing engagement with said lower cavity.

6. The apparatus of claim 5 wherein said vertical movement includes said lower body vertically moving with respect to said upper body and said lower portion of said ball to said selectively inhibit movement of said body with respect to said ball.

7. The apparatus of claim 6 wherein said lower ring includes a ring flattened portion and said lower body includes a lower body flattened portion that cooperatively inhibit rotational movement with respect to one another.

8. The apparatus of claim 3 wherein said ball adjustment member includes a screw mechanism.

9. The apparatus of claim 8 wherein said screw mechanism includes a clamping screw with a broached serrated head that corresponds with a broached pocket defined by said lever.

10. The apparatus of claim 9 wherein movement of said lever engages said clamping screw with an internal screw that is threaded within said lever.

11. The apparatus of claim 10 further comprising a timing broach that is adjustable with respect to said screw mechanism that adjusts said lockup.

* * * * *